US008008568B2

(12) United States Patent
Kobayashi

(10) Patent No.: US 8,008,568 B2
(45) Date of Patent: Aug. 30, 2011

(54) INFORMATION PROCESSING DEVICE AND METHOD, AND RECORDING MEDIUM

(75) Inventor: Yoshiyuki Kobayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 159 days.

(21) Appl. No.: 12/160,121

(22) PCT Filed: Jan. 5, 2007

(86) PCT No.: PCT/JP2007/050019

§ 371 (c)(1),
(2), (4) Date: Nov. 17, 2008

(87) PCT Pub. No.: WO2007/077993

PCT Pub. Date: Jul. 12, 2007

(65) Prior Publication Data

US 2009/0151547 A1 Jun. 18, 2009

(30) Foreign Application Priority Data

Jan. 6, 2006 (JP) ..... 2006-001519

(51) Int. Cl.
*G10H 1/38* (2006.01)
*G10H 1/22* (2006.01)

(52) U.S. Cl. ..... 84/613; 84/609; 84/615; 84/618; 84/637

(58) Field of Classification Search ..... 84/613
See application file for complete search history.

(56) References Cited

U.S. PATENT DOCUMENTS

| | | | | |
|---|---|---|---|---|
| 4,982,643 | A * | 1/1991 | Minamitaka | 84/613 |
| 5,852,252 | A * | 12/1998 | Takano | 84/650 |
| 2004/0255759 | A1* | 12/2004 | Gayama | 84/613 |
| 2005/0109194 | A1* | 5/2005 | Gayama | 84/613 |

FOREIGN PATENT DOCUMENTS

| | | |
|---|---|---|
| EP | 1 435 604 A1 | 7/2004 |
| JP | 06-290574 | 10/1994 |
| JP | 2004-185432 | 10/1994 |
| JP | 2000-227795 | 8/2000 |
| JP | 2003-330460 | 11/2003 |
| JP | 2004-184510 | 7/2004 |
| JP | 2004-233864 | 8/2004 |
| JP | 2005-156713 | 6/2005 |

OTHER PUBLICATIONS

Supplementary European Search Report mailed Jun. 22, 2011, from European Patent Office in counterpart European Application No. EP 07 70 6366 (6 pages).

* cited by examiner

*Primary Examiner* — Elvin G Enad
*Assistant Examiner* — Christopher Uhlir
(74) *Attorney, Agent, or Firm* — Finnegan, Henderson, Farabow, Garrett & Dunner, L.L.P.

(57) ABSTRACT

The present invention relates to an information processing device, an information processing method, and a recording medium for analyzing chord progressions more accurately. A featuring quantity extraction unit 41 extracts respectively a probability of given chords appearing simultaneously, a probability of transition from a given chord to another chord, if the given chord appeared, and a probability of transition of a given chord originating from another chord, if the given chord appeared, from chord progressions of musical compositions by analyzing waveforms of said musical compositions. A chord similarity calculation unit 42 calculates the similarities between the chord progressions of musical compositions and the user-input chord progressions based on those extracted these possibilities. A musical composition retrieving unit 43 retrieves musical composition chord progressions similar to the user-input chord progression based on the calculated similarities. The present invention is applicable to the information processing apparatus.

11 Claims, 23 Drawing Sheets

FIG. 6

MUSICAL COMPOSITION 1: C → B♭ → Am → G# → G → C → F → Dm → D → G, ...

MUSICAL COMPOSITION 2: C → D → F → C → A → Dm → Fm → C → D → G → C → F → G, ...

MUSICAL COMPOSITION 3: Am → Dm → E → Am → C → D → E → F → C → Dm → Am, ...

⋮

MUSICAL COMPOSITION N: Am → G → F → C → E → Am → G → F → G → Am → E, ...

FIG. 8

| | C | C# | D | ••• | Bm |
|---|---|---|---|---|---|
| C | 95% | 5% | 56% | ••• | 0% |
| C# | 5% | 13% | 7% | ••• | 0% |
| D | 56% | 7% | 45% | ••• | 0% |
| ⋮ | ⋮ | ⋮ | ⋮ | ⋮ | ⋮ |
| Bm | 0% | 0% | 0% | ••• | 0% |

MUSICAL COMPOSITION 1: C → B♭ → Am → G# → G → C → F → Dm → D → G ...

MUSICAL COMPOSITION 2: C → D → F → C → A → Dm → Fm → C → D → G → C → F → G ...

MUSICAL COMPOSITION 3: Am → Dm → E → Am → C → D → E → F → C → Dm → Am ...

⋮

MUSICAL COMPOSITION N: Am → G → F → C → E → Am → G → F → G → Am → E ...

FIG. 9

| | C | C# | D | ••• | Bm |
|---|---|---|---|---|---|
| C | 0% | 3% | 21% | ••• | 0% |
| ⋮ | ⋮ | ⋮ | ⋮ | ⋮ | ⋮ |
| F | 25% | 4% | 15% | ••• | 0% |
| ⋮ | ⋮ | ⋮ | ⋮ | ⋮ | ⋮ |
| Bm | 0% | 0% | 0% | ••• | 0% |

MUSICAL COMPOSITION 1: C → B♭ → Am → G# → G → C → F → Dm → D → G ...

MUSICAL COMPOSITION 2: C → D → F → C → A → Dm → Fm → C → D → G → C → F → G ...

MUSICAL COMPOSITION 3: Am → Dm → E → Am → C → D → E → F → C → Dm → Am ...

⋮

MUSICAL COMPOSITION N: Am → G → F → C → E → Am → G → F → G → Am → E ...

FIG.10

| | C | ••• | G | ••• | Bm |
|---|---|---|---|---|---|
| C | 0% | ••• | 31% | ••• | 0% |
| C# | 3% | ••• | 2% | ••• | 0% |
| D | 21% | ••• | 10% | ••• | 0% |
| ⋮ | ⋮ | ⋮ | ⋮ | ⋮ | ⋮ |
| Bm | 0% | ••• | 0% | ••• | 0% |

MUSICAL COMPOSITION 1: C → B♭ → Am → G# → G → C → F → Dm → D → G ...

MUSICAL COMPOSITION 2: C → D → F → C → A → Dm → Fm → C → D → G → C → F → G ...

MUSICAL COMPOSITION 3: Am → Dm → E → Am → C → D → E → F → C → Dm → Am ...

⋮

MUSICAL COMPOSITION N: Am → G → F → C → E → Am → G → F → G → Am → E ...

| | 1 | 2 | 3 | 4 |
|---|---|---|---|---|
| V (C → F → G → C) | V(C) | V(F) | V(G) | V(C) |
| V (C → D → F → C) | V(C) | V(D) | V(F) | V(C) |

FIG. 15

HERE ARE THE RETRIEVED MUSICAL COMPOSITIONS WHOSE CHORD PROGRESSIONS ARE SIMILAR TO THE PROGRESSION OF "C→F→G→C."

1. MUSICAL COMPOSITION 2
2. MUSICAL COMPOSITION 3
...
10. MUSICAL COMPOSITION N
11. MUSICAL COMPOSITION 1
...

FIG.19

| | ••• | D → G | D → G# | ••• | Bm → Bm |
|---|---|---|---|---|---|
| ⋮ | ⋮ | ⋮ | ⋮ | ⋮ | ⋮ |
| C → F | ••• | 13% | 1% | ••• | 0% |
| C → F# | ••• | 1% | 0% | ••• | 0% |
| ⋮ | ⋮ | ⋮ | ⋮ | ⋮ | ⋮ |
| Bm → Bm | ••• | 0% | 0% | ••• | 0% |

MUSICAL COMPOSITION 1: C → B♭ → Am → G# → G → C → F → Dm → D → G ...

MUSICAL COMPOSITION 2: C → D → F → C → A → Dm → Fm → C → D → G → C → F → G ...

MUSICAL COMPOSITION 3: Am → Dm → E → Am → C → D → E → F → C → Dm → Am ...

⋮

MUSICAL COMPOSITION N: Am → G → F → C → E → Am → G → F → G → Am → E ...

FIG.20

| | ••• | G | G# | A | ••• | Bm |
|---|---|---|---|---|---|---|
| C → C | ••• | 0% | 0% | 0% | ••• | 0% |
| ⋮ | ⋮ | ⋮ | ⋮ | ⋮ | ⋮ | ⋮ |
| F → C | ••• | 6% | 0% | 1% | ••• | 0% |
| ⋮ | ⋮ | ⋮ | ⋮ | ⋮ | ⋮ | ⋮ |
| Bm → Bm | ••• | 0% | 0% | 0% | ••• | 0% |

FIG.21

| | ••• | G#m | Am | ••• | Bm |
|---|---|---|---|---|---|
| C → C | ••• | 0% | 0% | ••• | 0% |
| ⋮ | ⋮ | ⋮ | ⋮ | ⋮ | ⋮ |
| C → G | ••• | 0% | 6% | ••• | 0% |
| ⋮ | ⋮ | ⋮ | ⋮ | ⋮ | ⋮ |
| Bm → Bm | ••• | 0% | 0% | ••• | 0% |

FIG.23

| | 1 | 2 | 3 |
|---|---|---|---|
| V (C → F → G → C) | V(C → F) | V(F → G) | V(G → C) |
| V (C → D → F → C) | V(C → D) | V(D → F) | V(F → C) |

FIG.24

| | 1 | 2 | 3 | 4 | 1 | 2 | 3 |
|---|---|---|---|---|---|---|---|
| V (C → F → G → C) | V(C) | V(F) | V(G) | V(C) | V(C → F) | V(F → G) | V(G → C) |
| V (C → D → F → C) | V(C) | V(D) | V(F) | V(C) | V(C → D) | V(D → F) | V(F → C) |

INFORMATION PROCESSING DEVICE AND METHOD, AND RECORDING MEDIUM

TECHNICAL FIELD

The present invention relates to an information processing device, an information processing method, and a recording medium. More particularly, the invention relates to an information processing device, an information processing method, and a recording medium for analyzing chord progressions more accurately than before.

BACKGROUND ART

A number of methods have been proposed by which to analyze the chord progressions of musical compositions (in what is known as chord progression analysis). Chord progression analysis typically involves analyzing the chord progressions of numerous musical compositions recorded on a personal computer or a portable music player in order to search for desired musical compositions based on the analyzed chord progressions of the compositions.

Usually, the chord progressions of given music compositions are analyzed on the basis of the chords obtained by analyzing the waveforms representative of audio signals constituting the musical compositions in question. More specifically, as shown in FIG. 1, analyzing the waveforms of a musical composition A (waveforms) gives the chord progression of C, F, G and C, in that order. Likewise, analyzing the waveforms of a musical composition B provides the chord progression of CM7, Dm7, G7 and CM7, in that order. A check is then made to determine whether the chord C of the musical composition A is similar to the chord CM7 of the musical composition B. A check is also made to see if the chord progression of C, F, G and C of the musical composition A is similar to the chord progression of CM7, Dm7, G7 and CM7 of the musical composition B.

Some errors are contained in the chord progressions acquired by chord progression analysis. How such errors occur varies depending on the algorithm for determining chords (and their progressions). Illustratively, ordinary chord progression analysis may yield an erroneous chord progression of C, F, G and Cm instead of the correct chord progression of C, F, G and C, as shown in FIG. 2. In this case, the major chord C is mistaken for the minor chord Cm which may well be analyzed as a chord having a totally different musical significance.

In the above example, the so-called chord distance perspective according to traditional music theory cannot be adopted as it is.

In chord progression analysis, it is relatively easy to distinguish between major and minor chords. The difficulty increases—and the precision of analysis drops—when it comes to detecting, say, diverse four-note chords.

Meanwhile, there exist musical composition data creating apparatuses (such as one disclosed in Patent Document 1) which extract the frequency component corresponding to each note from the audio signals representative of musical compositions, detect from the extracted frequency components corresponding to each note a first and a second chord candidate each formed by three frequency components amounting to a high level, and smooth out the progressions of the first and the second chord candidates in order to create musical composition data.

Patent Document 1: Japanese Patent Laid-Open No. 2004-184510

DISCLOSURE OF INVENTION

Technical Problem

There still remains the problem of the inability to analyze accurately the chord progressions of musical compositions. This is due to the errors included in the chord progressions acquired by chord progression analysis of the audio signals constituting the musical compositions of interest.

For example, some errors are almost always contained in the chord progressions obtained by ordinary chord progression analysis. The way such errors occur varies depending on the algorithm for determining chords. For that reason, the chord distance perspective based on music theory cannot be adopted as it is.

Furthermore, the musical composition data creating apparatus disclosed in the above-cited Japanese Patent Laid-Open No. 2004-184510 apparently fails to create accurate musical composition data. That is because the disclosed apparatus creates musical composition data by detecting chord candidates from the frequency components of the audio signals making up target musical compositions, and the chord progressions are likely to include errors.

The present invention has been made in view of the above circumstances and provides arrangements such as to analyze chord progressions more accurately than before.

In carrying out the present invention and according to one embodiment thereof, there is provided an information processing device including: extraction means for extracting featuring quantities from chord progressions of musical compositions attained by analyzing waveforms of the musical compositions, the featuring quantities being related to chords constituting each of the chord progressions; and calculation means for calculate similarities between a chord progression and other chord progression, on the basis of the extracted featuring quantities.

Preferably, the extraction means may extract as the featuring quantities either relations between the chords appearing simultaneously or transition relations between the chords.

Preferably, the information processing device according to the present invention may further include a recording means for record the extracted featuring quantities; wherein the calculation means may calculate similarities between the chord progression and the other chord progression, on the basis of the recorded featuring quantities.

Preferably, the calculation means may calculate similarities between chords constituting each of the chord progressions and the other chords of the chord progression in question, on the basis of the extracted featuring quantities.

Preferably, the extraction means may include: first featuring quantity extraction means for extracting a first probability indicating the probability of given chords appearing simultaneously in each of the chord progressions; second featuring quantity extraction means for extracting a second probability indicating the probability of transition from a given chord to another chord in the chord progression in question; and third featuring quantity extraction means for extracting a third probability indicating the probability of transition from the other chord to the given chord in the chord progression in question; wherein the calculation means may calculate similarities between the chord progression and the other chord progression, on the basis of the first probability, the second probability, and the third probability extracted with regard to the chords constituting each of the chord progressions.

Preferably, the extraction means may include: first featuring quantity extraction means for extracting a first probability indicating the probability of given chord progressions appearing simultaneously in the chord progressions; second featuring quantity extraction means for extracting a second probability indicating the probability of transition from a given chord progression to another chord progression in the chord progressions; and third featuring quantity extraction means for extracting a third probability indicating the probability of transition from the other chord progression to the given chord progression in the chord progressions; wherein the calculation means may calculate similarities between the chord progression and the other chord progression, on the basis of the first probability, the second probability, and the third probability extracted with regard to each of the chord progressions.

Preferably, the calculation means may calculate similarities between the chord progression constituting each of the chord progressions and a chord progression designated by a user, using a predetermined algorithm and on the basis of the extracted featuring quantities.

Preferably, the information processing device according to the present invention may further include retrieval means for performing musical composition retrieval from the musical compositions on the basis of the calculated similarities.

Preferably, the predetermined algorithm may involve calculating vector correlation of the featuring quantities.

According to another embodiment of the present invention, there is provided an information processing method including the steps of: extracting featuring quantities from chord progressions of musical compositions attained by analyzing waveforms of the musical compositions, the featuring quantities being related to the chords constituting each of the chord progressions; and calculating similarities between the chord progression constituting each of the chord progressions and the other chord progressions, on the basis of the extracted featuring quantities.

According to a further embodiment of the present invention, there is provided a recording medium which stores a program for causing a computer to execute a chord progression analyzing process including the steps of: extracting featuring quantities from chord progressions of musical compositions attained by analyzing waveforms of the musical compositions, the featuring quantities being related to the chords constituting each of the chord progressions; and calculating similarities between the chord progression constituting each of the chord progressions and the other chord progression, on the basis of the extracted featuring quantities.

According to an aspect of the present invention, featuring quantities are first extracted from chord progressions of musical compositions by analyzing waveforms of the musical compositions, the featuring quantities being related to the chords constituting each of the chord progressions. Similarities are then calculated between the chord progression constituting each of the chord progressions and the other chord progression, on the basis of the extracted featuring quantities.

ADVANTAGEOUS EFFECTS

According to the present invention, as outlined above, chord progressions may be analyzed more accurately than before.

BRIEF DESCRIPTION OF DRAWINGS

FIG. 6 is a schematic view explanatory of chord progression analysis;

FIG. 8 is a schematic view showing typical simultaneous chord appearance probabilities extracted by a simultaneous chord appearance probability extracting unit;

FIG. 9 is a schematic view showing typical chord transition destination probabilities extracted by a chord transition destination probability extracting unit;

FIG. 10 is a schematic view showing typical chord transition origin probabilities extracted by a chord transition origin probability extracting unit;

FIG. 15 is a schematic view showing a typical screen of an output unit displaying retrieved results of musical compositions;

FIG. 19 is a schematic view showing typical simultaneous chord progression appearance probabilities extracted by a simultaneous chord progression appearance probability extracting unit;

FIG. 20 is a schematic view showing typical chord progression transition destination probabilities extracted by a chord progression transition destination probability extracting unit;

FIG. 21 is a schematic view showing typical chord progression transition origin probabilities extracted by the chord progression transition origin probability extracting unit;

FIG. 23 is a schematic view detailing how similarities are calculated between chord progressions;

FIG. 24 is another schematic view detailing how similarities are calculated between chord progressions.

EXPLANATION OF REFERENCE NUMERALS

Figure 1:
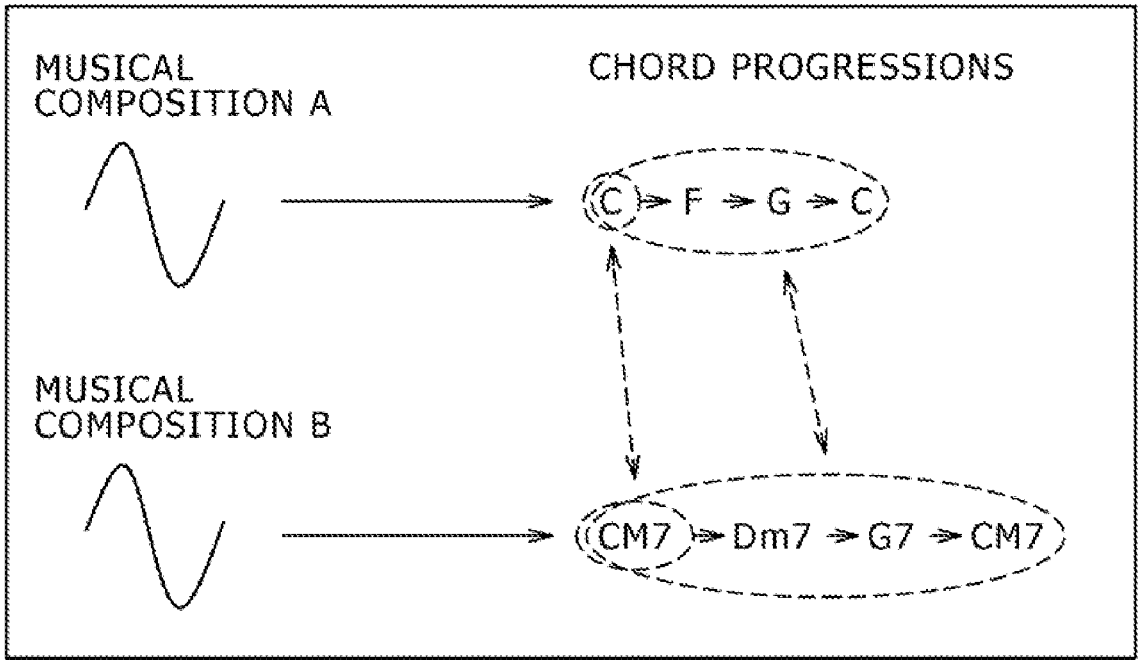
FIG. 1 is a schematic view explanatory of ordinary chord progression analysis.
Figure 2:
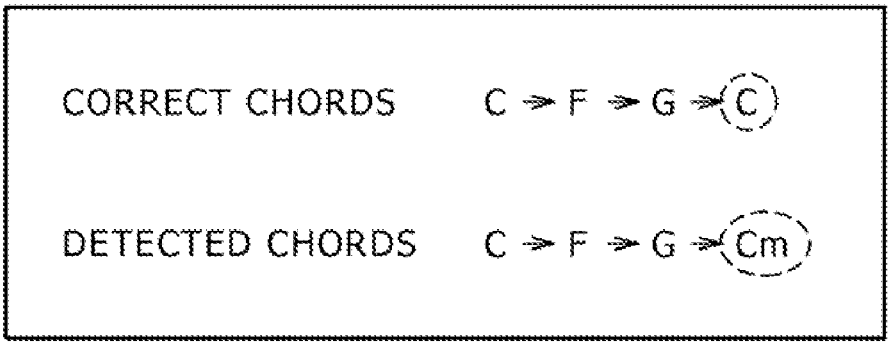
FIG. 2 is another schematic view explanatory of ordinary chord progression analysis.

Reference numeral 1 stands for a personal computer; 11 for a CPU; 12 for a ROM; 13 for a RAM; 16 for a display unit; 17 for an output unit; 18 for a recording unit; 19 for a communication unit; 20 for a drive; 21 for removable media; 31 for a chord progression analyzing unit; 41 for a featuring quantity extraction unit; 42 for a chord similarity calculation unit; 43 for a musical composition retrieving unit; 51 for a simultaneous chord appearance probability extracting unit; 52 for a chord transition destination probability extracting unit; 53 for a chord transition origin probability extracting unit; 61 for a simultaneous chord progression appearance probability extracting unit; 62 for a chord progression transition destination probability extracting unit; and 63 for a chord progression transition origin probability extracting unit.

BEST MODE FOR CARRYING OUT THE INVENTION

Embodiments of the present invention will now be described with reference to the accompanying drawings.

Figure 3:
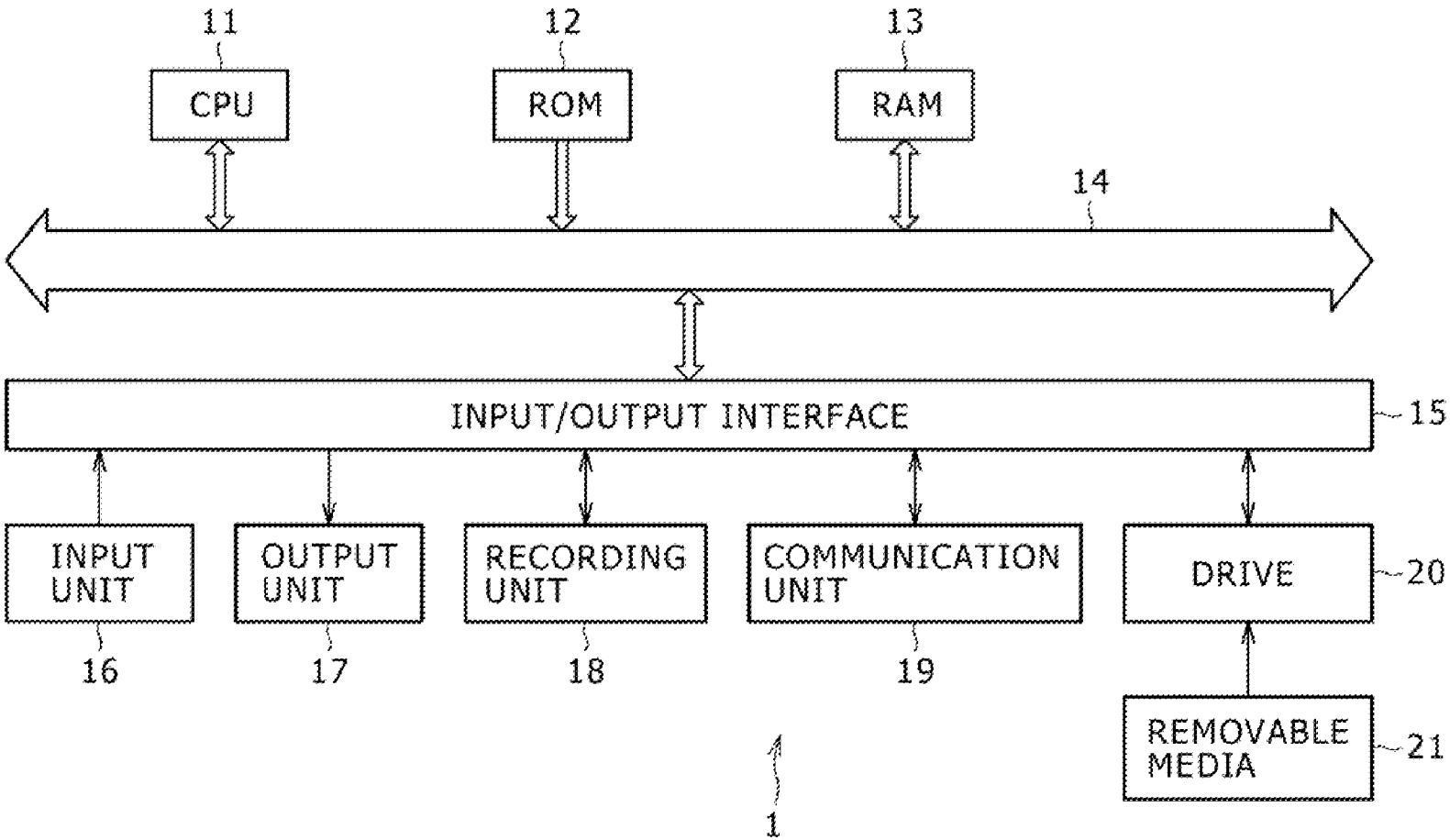
FIG. 3 is a block diagram showing a typical hardware structure of a personal computer.

FIG. 3 is a block diagram showing a typical hardware structure of a personal computer 1.

In the personal computer 1 of an example in FIG. 3, a CPU (central processing unit) 11 performs various processes in accordance with programs stored in a ROM (read only memory) 12 or with programs loaded from a recording unit 18 into a RAM (random access memory) 13. The RAM 13 also accommodates data that may be needed by the CPU 11 in carrying out its various processing.

The CPU 11, ROM 12, and RAM 13 are interconnected to each other by a bus 14. An input/output interface 15 is also connected to the bus 14.

The input/output interface 15 is connected with an input unit 16, an output unit 17, the recording unit 18, and a communication unit 19. The input unit 16 is typically made up of a keyboard and a mouse. The output unit 17 is generally constituted by speakers and a display such as LCD (liquid crystal display). The recording unit 18 is illustratively formed by a hard disk drive. The communication unit 19 typically controls processes of communication with other devices over networks such as the Internet.

A drive 20 may be connected as needed to the input/output interface 15. A piece of removable media 21 including magnetic disks, optical disks, magneto-optical disks or semiconductor memory may be attached to the drive 20, and the programs retrieved from the attached medium are installed as needed into the recording unit 18.

The hardware structure of the personal computer 1 is not limited to what is shown in FIG. 3. The personal computer 1 need only possess a functional structure such as one depicted in FIG. 4, to be discussed below.

Figure 4:
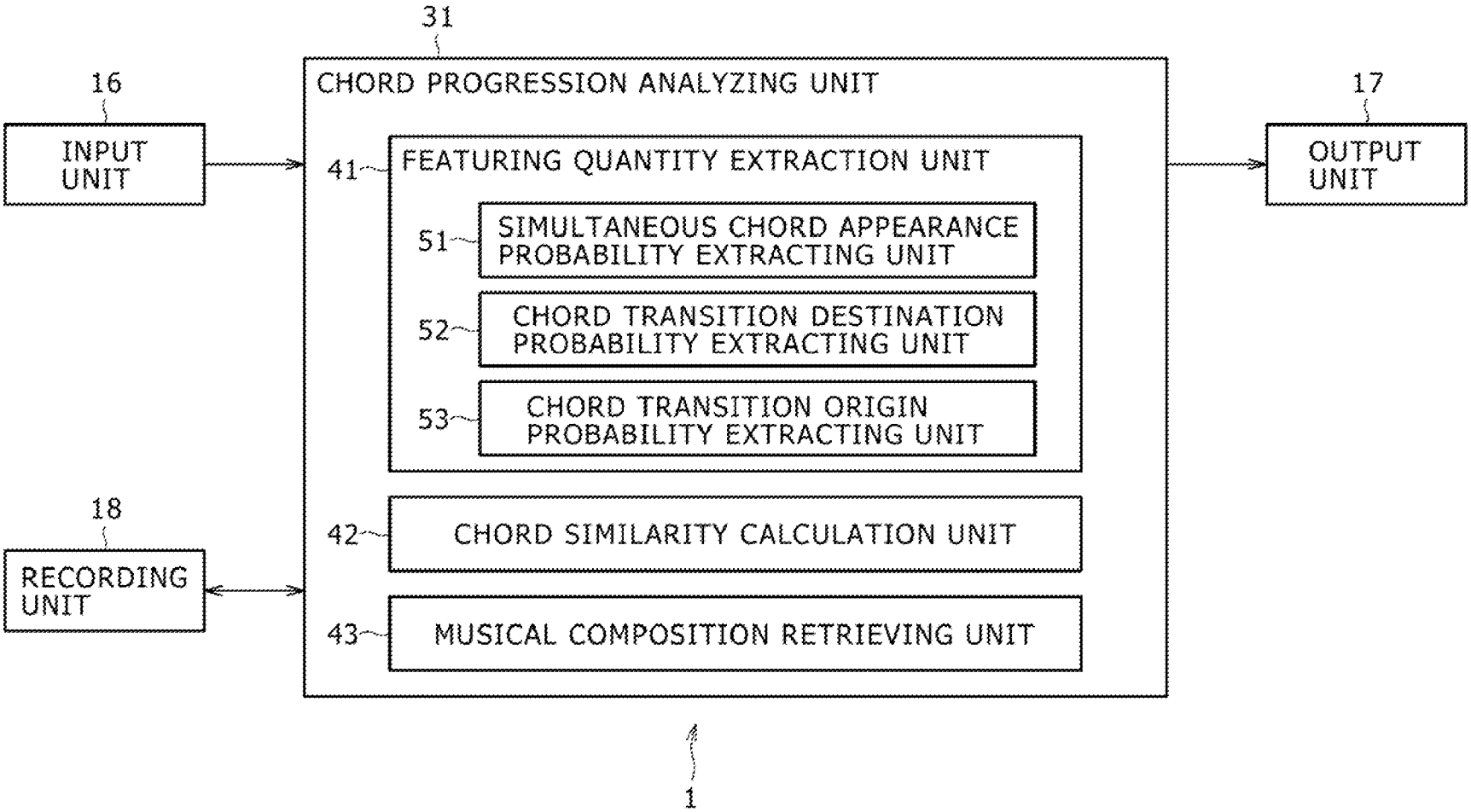
FIG. 4 is a block diagram showing a typical functional structure of the personal computer.

FIG. 4 is a block diagram showing a typical functional structure of the personal computer 1. Of the reference numerals in FIG. 4, those already used in FIG. 3 designate like or corresponding parts, and their descriptions will be omitted hereunder where redundant.

The personal computer 1 is a device that performs the predetermined process for analyzing the chord progressions of musical compositions using audio signals reproduced from data of the compositions. As such, the personal computer 1 is an embodiment of the information processing device according to the present invention.

The personal computer 1 is structured to include the input unit 16, output unit 17, recording unit 18, and a chord progression analyzing unit 31.

With this embodiment, the personal computer 1 has the hardware structure shown in FIG. 3 described above. In that structure, the chord progression analyzing unit 31 is constituted illustratively by software (program) for execution by the CPU 11 in FIG. 3. If the hardware structure of the personal computer 1 is made different from what is shown in FIG. 3, then the chord progression analyzing unit 31 may be implemented either as a hardware unit or as a combination of software and hardware elements.

The chord progression analyzing unit 31 performs processes necessary for analyzing the chord progressions of musical compositions using waveforms of the compositions (i.e., their data) recorded on the recording unit 18.

The chord progression analyzing unit 31 is structured to include a featuring quantity extraction unit 41, a chord similarity calculation unit 42, and a musical composition retrieving unit 43.

The featuring quantity extraction unit 41 extracts (i.e., calculates) featuring quantities from the chord progressions analyzed from the waveforms of musical compositions by performing the featuring quantity extracting process. The featuring quantity extraction unit 41 has the extracted featuring quantities recorded to the recording unit 18 (or to the RAM 13 or the like).

The featuring quantity extraction unit 41 is structured to include a simultaneous chord appearance probability extracting unit 51, a chord transition destination probability extracting unit 52, and a chord transition origin probability extracting unit 53.

The simultaneous chord appearance probability extracting unit 51 extracts (calculates) the probability of two given chords appearing simultaneously from the chord progressions analyzed from the waveforms of musical compositions (the simultaneous chord appearance probability).

The chord transition destination probability extracting unit 52 extracts (calculates) the probability of transition from a given chord to another chord in the chord progressions analyzed from the waveforms of musical compositions (the chord transition destination probability).

The chord transition origin probability extracting unit 53 extracts (calculates) the probability of transition of a given chord originating from another chord in the chord progressions analyzed from the waveforms of musical compositions (the chord transition origin probability).

The chord similarity calculation unit 42 performs the predetermined process for calculating similarities between chord progressions (or chords) based on the featuring quantities recorded on the recording unit 18 (or in the RAM 13).

The musical composition retrieving unit 43 searches musical composition data stored in the recording unit 18 based on the result of those similarities between chord progressions which were calculated by the chord similarity calculation unit 42.

Incidentally, as described above, chord progression analysis involves analyzing the chord progressions of the waveforms from a large number of musical compositions recorded on the personal computer 1. The chord progressions derived from the analysis are used illustratively as the basis for retrieving desired musical compositions out of those recorded. What follows is a description of how desired music compositions are typically retrieved by the personal computer 1 from chord progressions through a process utilizing chord progression analysis.

Figure 5:
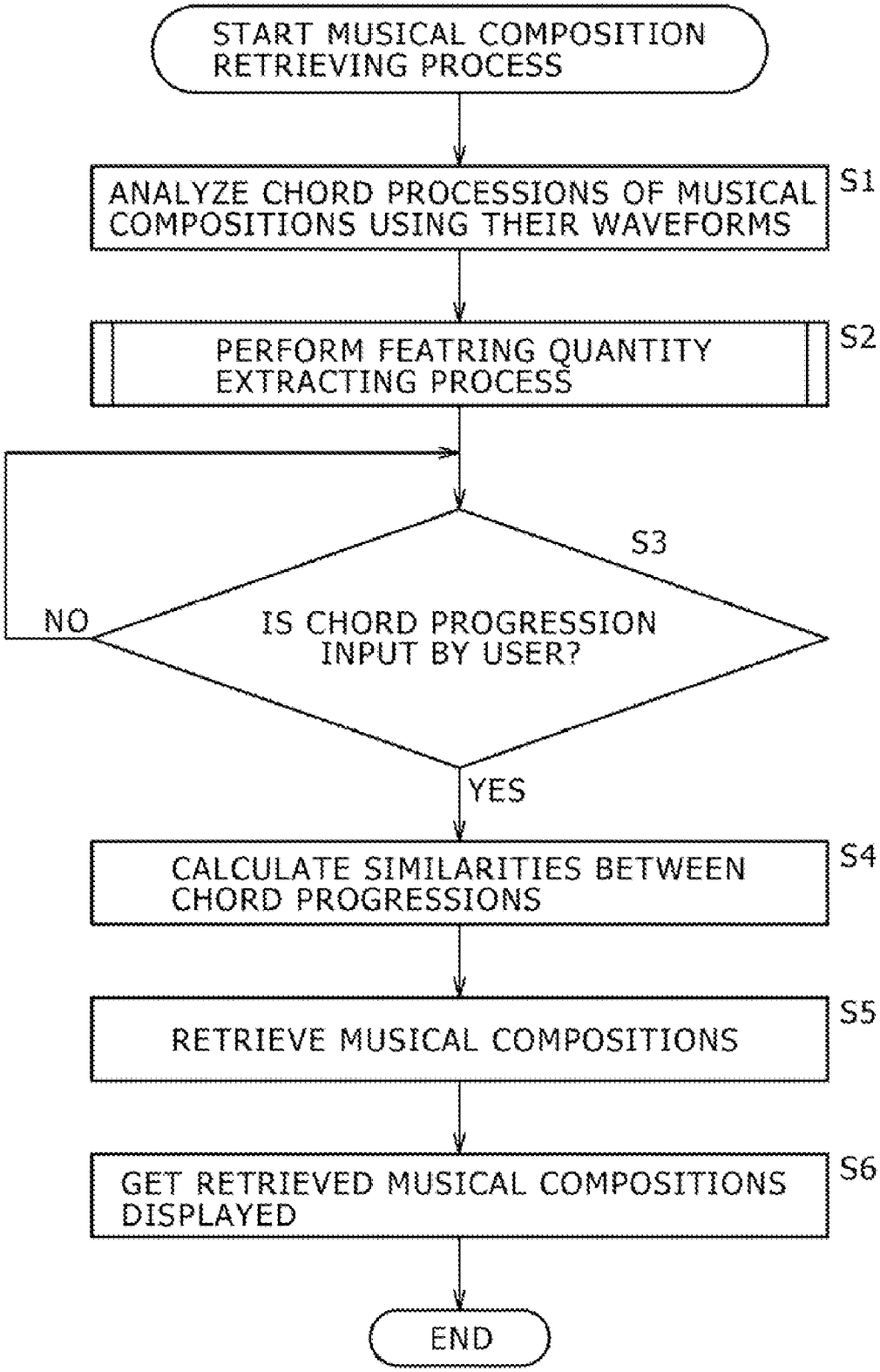
FIG. 5 is a flowchart of steps constituting a musical composition retrieving process performed by the personal computer.

FIG. 5 is a flowchart of steps constituting a musical composition retrieving process performed by the personal computer 1.

In step S1, the chord progression analyzing unit 31 performs chord progression analysis on musical composition waveforms. Illustratively, the chord progression analyzing unit 31 in step S1 analyzes the chord progression of a plurality of musical compositions by analyzing the waveforms of audio signals reproduced from the data of the musical compositions, the data having been compressed by such methods as MP3 (MPEG Audio Layer-3) or AAC (Advanced Audio Coding).

More specifically, it is assumed that the data of musical compositions 1, 2, 3, . . . , N recorded on the recording unit 18 are analyzed by the chord progression analyzing unit 31. As shown in FIG. 6, it is assumed that the analysis allows the chord progression analyzing unit to acquire a chord progression of C, B♭, Am, G♯, G, C, F, Dm, D, G, . . . , in that order, from the musical composition 1; a chord progression of C, D, F, C, A, Dm, Fm, C, D, G, C, F, G, . . . , in that order, from the musical composition 2; and a chord progression of Am, Dm, E, Am, C, D, E, F, C, Dm, Am, . . . , in that order, from the musical composition 3. The chord progression analyzing unit 31 proceeds likewise to analyze the musical composition data to acquire the chord progressions of the musical compositions 4 through N−1, and obtain lastly a chord progression of Am, G, F, C, E, Am, G, F, G, Am, E, . . . , in that order, from the musical composition N.

In the manner described above, the chord progression analyzing unit 31 analyzes the waveforms of the musical compositions 1 through N to obtain their chord progressions. It is also assumed that the chord progressions to be analyzed from the musical compositions 1 through N are all keyed to the same chord such as C.

The musical composition data to be analyzed by the chord progression analyzing unit 31 is not limited to the data recorded on the recording unit 18. Other musical composition data may also be utilized, including the data acquired via a network (not shown) from servers (not shown) specialized in holding recorded musical compositions. The musical composition data is thus acceptable as long as it has been compressed by appropriate data compression methods. The data may be recorded on any type of recording apparatus.

In step S2, the featuring quantity extraction unit 41 performs a featuring quantity extracting process on the chord progressions analyzed from the waveforms of a plurality of musical compositions and extracts the featuring quantity. Illustratively, the featuring quantity extraction unit 41 in step S2 extracts featuring quantities by analyzing either the relations between chords appearing simultaneously or the transition relations between chords in the chord progressions analyzed from the waveforms of musical compositions. The extracted featuring quantities are recorded to the recording unit 18 (or to the RAM 13 or the like). The relations between chords appearing simultaneously and the transition relations between chords will be described later.

The featuring quantity extracting process performed by the featuring quantity extraction unit 41 in step S2 is described below in more detail with reference to the flowchart of FIG. 7.

In step S11, the simultaneous chord appearance probability extracting unit 51 extracts the probabilities of chords appearing simultaneously in the chord progressions of analyzed musical compositions. Illustratively, the simultaneous chord appearance probability extracting unit 51 in step S11 extracts the probability of two given chords appearing simultaneously in the chord progressions of musical compositions 1 through N (the simultaneous chord appearance probability).

FIG. 8 is a schematic view showing typical simultaneous chord appearance probabilities extracted (i.e., calculated) by the simultaneous chord appearance probability extracting unit 51.

In the table shown in the upper half of FIG. 8, the leftmost column and the topmost row have items denoting chord names. Although not all chords are shown here for purpose of simplification and illustration, the second item from top in the leftmost column denotes the chord C, the third item from top indicates the chord C♯, and the fourth item from top shows the chord D. From the fifth item down in the leftmost column, further chords are assumed to appear ranging from major to minor chords including D♯, E, F, F♯, G, G♯, A, B♭, B, Cm, C♯m, Dm, D♯m, Em, Fm, F♯m, Gm, G♯m, Am, B♭m, and Bm. Likewise, the second item from left in the topmost row denotes the chord C, the third item from left indicates the chord C♯, and the fourth item from left shows the chord D. From the fifth item on in the topmost row, further chords are assumed to appear ranging from major to minor chords including D♯, E, F, F♯, G, G♯, A, B♭, B, Cm, C♯m, Dm, D♯m, Em, Fm, F♯m, Gm, G♯m, Am, B♭m, and Bm.

In other words, the table shown in an example in FIG. 8 constitutes a matrix of cells representing the major chords C, C♯, D, D♯, E, F, F♯, G, G♯, A, B♭, and B, as well as the minor chords Cm, C♯m, Dm, D♯m, Em, Fm, F♯m, Gm, G♯m, Am, B♭m on each of the leftmost column and the topmost row.

The chord progressions shown in the lower half of FIG. 8 are those of the musical compositions 1 through N mentioned above. In the musical compositions 1 through N, The simultaneous chord appearance probability is extracted illustratively for chord C appearing simultaneously with the same or with one of the other chords (C, D, . . . ), as indicated by broken lines in FIG. 8.

The table shown in the example in FIG. 8 shows illustratively the simultaneous chord appearance probabilities regarding the chords in the musical compositions 1 through N.

More specifically, in the musical compositions 1 through N, the probabilities of the chord C appearing simultaneously with the other chords are extracted as follows: the probability of the chord C appearing simultaneously with the same chord C is extracted at 95%, with the chord C♯ at 5%, with the chord D at 56%, and with the chord Bm at 0%. Likewise, in the musical compositions 1 through N, the probabilities of the chord C♯ appearing simultaneously with the other chords are extracted as follows: the probability of the chord C♯ appearing simultaneously with the chord C is extracted at 5%, with the same chord C♯ at 13%, with the chord D at 7%, . . . , and with the chord Bm at 0%. The probabilities of the chord D appearing simultaneously with the other chords are extracted as follows: the probability of the chord D appearing simultaneously with the chord C is extracted at 56%, with the chord C♯ at 7%, with the same chord D at 45%, . . . , and with the chord Bm at 0%.

Similarly, in the musical compositions 1 through N, the probability of each of the chords D♯ through B♭m appearing simultaneously with the same or each of the other chords is extracted. Lastly, the probabilities of the chord Bm appearing simultaneously with the other chords are extracted as follows: the probability of the chord Bm appearing simultaneously with the chord C is extracted at 0%, with the chord C♯ at 0%, with the chord D at 0%, . . . , and with the same chord Bm at 0%.

As described, from the musical compositions 1 through N, a total of 24 simultaneous chord appearance probabilities are acquired for each of the chords (C, C♯, D, D♯, E, F, F♯, G, G♯, A, B♭, B, Cm, C♯m, Dm, D♯m, Em, Fm, F♯m, Gm, G♯m, Am, B♭m, and Bm).

In other words, through the process of step S11, the simultaneous chord appearance probability extracting unit 51 may be said to extract the relations between chords appearing simultaneously, by calculating the simultaneous appearance probabilities of the chords in the musical compositions (i.e., musical compositions 1 through N).

Figure 7:
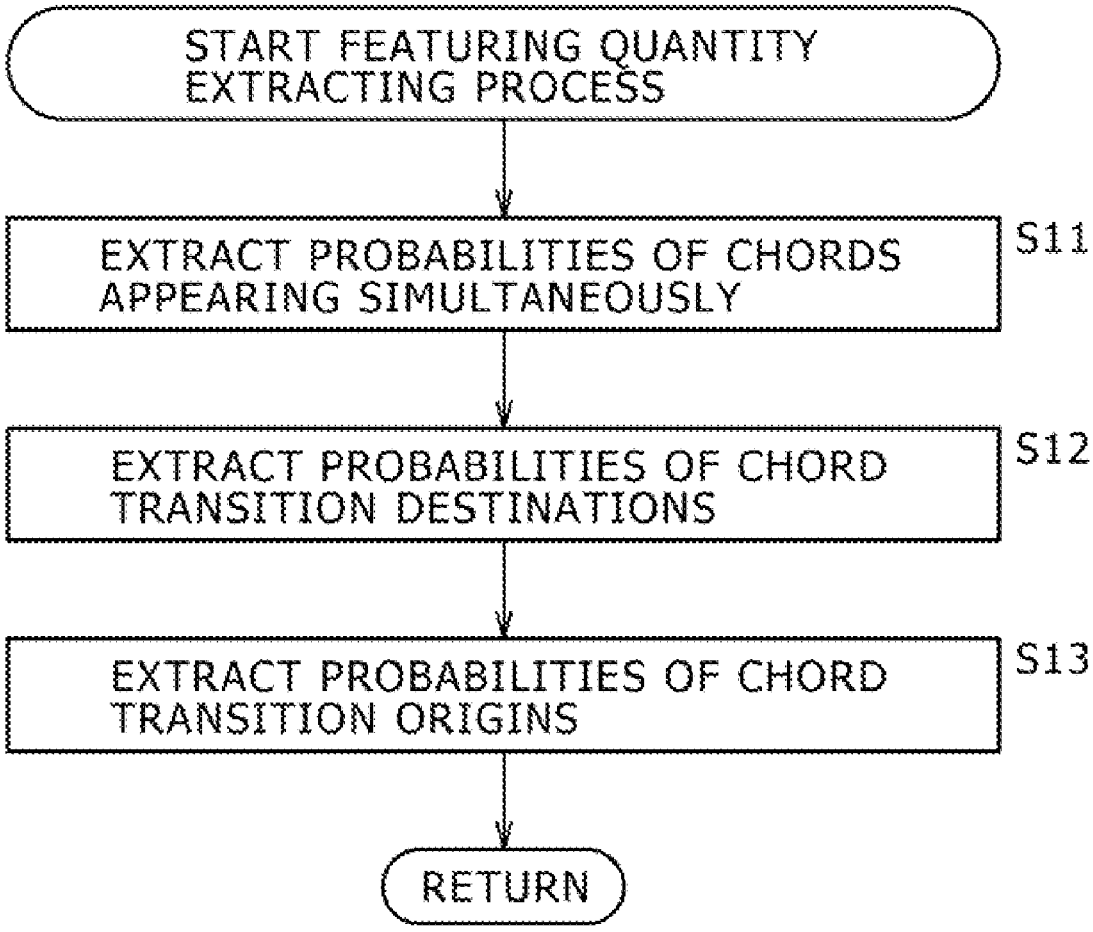
FIG. 7 is a flowchart of detailed steps constituting a featuring quantity extracting process performed by a featuring quantity extraction unit.

In step S12 back in the flowchart of FIG. 7, the chord transition destination probability extracting unit 52 extracts the probabilities of chord transition destinations based on the chord progressions of the analyzed musical compositions. For example, the chord transition destination probability extracting unit 52 in step S12 extracts the probability of transition of a given chord to another chord if the given chord appears, from the chord transitions in the musical compositions 1 through N (the chord transition destination probability).

FIG. 9 is a schematic view showing typical chord transition destination probabilities extracted (i.e., calculated) by the chord transition destination probability extracting unit 52.

In the table shown in the upper half of FIG. 9, the leftmost column and the topmost row contain the items representing the same chord names as those in the example of the table of FIG. 8, and their descriptions are omitted hereunder.

The chord progressions shown in the lower half of FIG. 9 are those of the musical compositions 1 through N discussed above. The probability of transition from one chord to another is extracted illustratively from the musical compositions 1 through N. What is typically calculated is the probability of, say, the chord C making transition to another chord such as the chord D, or the probability of the chord F making transition to another chord such as the chord C, as indicated by broken lines in FIG. 9.

An example in FIG. 9 shows illustratively the chord transition destination probabilities of the chords in the musical compositions 1 through N.

More specifically, in the musical compositions 1 through N, the probabilities of the chord C making transition to the other chords are extracted as follows: the probability of the chord C making transition to the same chord C is extracted at 0%, to the chord C♯ at 3%, to the chord D at 21%, . . . , and to the chord Bm at 0%. Similarly, in the musical compositions 1 through N, the probability of each of the chords C♯ through E making transition to the same or each of the other chords is extracted. The probabilities of the chord F making transition to the other chords are extracted as follows: the probability of the chord F making transition to the chord C is then extracted at 25%, to the chord C♯ at 4%, to the chord D at 15%, . . . , and to the chord Bm at 0%. Likewise, in the musical compositions 1 through N, the probability of each of the chords F♯ through B♭m making transition to the same or each of the other chords is extracted. Lastly, the probabilities of the chord Bm making transition to the other chords are extracted as follows: the probability of the chord Bm making transition to the chord C is extracted at 0%, to the chord C♯ at 0%, to the chord D at 0%, . . . , and to the chord Bm at 0%.

As described, the chord progressions from the musical compositions 1 through N, 24 chord transition destination probabilities are acquired for each of the chords (C, C♯, D, D♯, E, F, F♯, G, G♯, A, B♭, B, Cm, C♯m, Dm, D♯m, Em, Fm, F♯m, Gm, G♯m, Am, B♭m, and Bm).

In other words, through the process of step S12, the chord transition destination probability extracting unit 52 may be said to extract the transition relations between chords by calculating the probabilities of transition from one chord to another in the musical compositions (i.e., musical compositions 1 through N).

In step S13 back in the flowchart of FIG. 7, the chord transition origin probability extracting unit 53 extracts the probabilities of chord transition origins based on the chord progressions of the analyzed musical compositions. This step terminates the featuring quantity extracting process. Illustratively, the chord transition origin probability extracting unit 53 in step S13 calculates the probability of a given chord originating from the same or each of the other chords in the chord progressions of the musical compositions 1 through N (the chord transition origin probability).

FIG. 10 is a schematic view showing typical chord transition origin probabilities extracted (i.e., calculated) by the chord transition origin probability extracting unit 53.

In the table shown in the upper half of FIG. 10, the leftmost column and the topmost row contain the items representing the same chord names as those in the example of the table of FIG. 8, and their descriptions are omitted hereunder.

The chord progressions shown in the lower half of FIG. 10 are those of the musical compositions 1 through N discussed above. The probability of one chord originating from another chord is extracted illustratively from the musical compositions 1 through N. What is typically calculated is the probability of, say, the chord C originating from another chord such as the chord G, or the probability of the chord D originating from another chord such as the chord C as indicated by broken lines in FIG. 10.

An example in FIG. 10 shows illustratively the chord transition origin probabilities regarding the chords in the musical compositions 1 through N.

More specifically, in the musical compositions 1 through N, the probabilities of the chord C originating from the other chords are extracted as follows: the probability of the chord C originating from the same chord C is extracted at 0%, . . . from the chord G at 31%, . . . and from the chord Bm at 0%. Similarly, in the musical compositions 1 through N, the probabilities of the chord C♯ originating from the other chords are extracted as follows: the probability of the chord C♯ originating from the chord C is extracted at 3%, . . . from the chord G at 2%, . . . and from the chord Bm at 0%. The probabilities of the chord D originating from the other chords are extracted as follows: the probability of the chord D originating from the chord C is extracted at 21%, . . . from the chord G at 10%, . . . and from the chord Bm at 0%.

Likewise, in the musical compositions 1 through N, the probability of each of the chords D♯ through B♭m originating from the same or one of the other chords is calculated. Lastly, the probability of the Bm originating from the chord C is extracted at 0%, . . . from the chord G at 0%, . . . and from the chord Bm at 0%.

In the manner described above, from the musical compositions 1 through N, a total of 24 chord transition origin probabilities are acquired for each of the chords (C, C♯, D, D♯, E, F, F♯, G, G♯, A, B♭, B, Cm, C♯m, Dm, D♯m, Em, Fm, F♯m, Gm, G♯m, Am, B♭m, and Bm).

In other words, through the process of step S13, the chord transition origin probability extracting unit 53 may be said to extract the transition relations between chords by calculating the probabilities of one chord originating from another chord in the musical compositions (i.e., musical compositions 1 through N).

Figure 11:
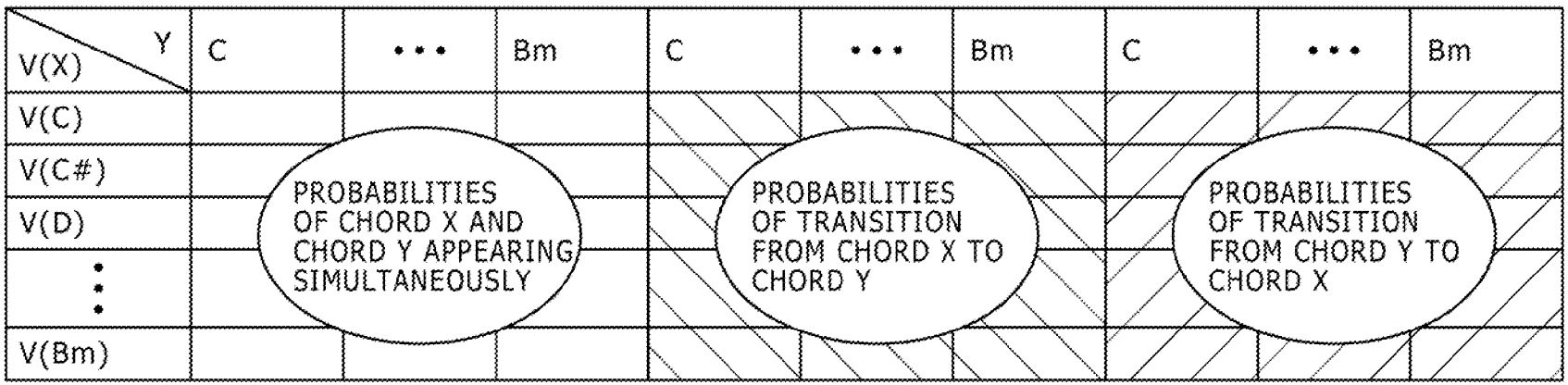
FIG. 11 is a schematic view explanatory of featuring quantities extracted by the featuring quantity extraction unit.

FIG. 11 is a schematic view explanatory of featuring quantities extracted by the featuring quantity extraction unit 41.

An example shown in the table in FIG. 11 integrates three tables as one crosswise: table of simultaneous chord appearance probabilities (FIG. 8), table of chord transition destination probabilities (FIG. 9), and table of chord transition origin probabilities (FIG. 10). In the table of FIG. 11, the items in the leftmost column stand for chords X (indicated as V(X) in the figure; the reason for this will be discussed later), and the items in the topmost row denote chords Y. The items in the leftmost column and the second through the 25th items from left in the topmost row constitute cells (shown blank in table in FIG. 11) representing the simultaneous chord appearance probabilities of the chords X in combination with the chords Y. The items in the leftmost column and the 26th through the 49th items from left in the topmost row make up cells (shown shaded with falling diagonals in the table shown in FIG. 11) indicating the probabilities of transition from the chords X to the chords Y. The items in the leftmost column and the 50th through the 73rd items from left in the topmost row form cells (shown shaded with rising diagonals in the table shown in FIG. 11) denoting the probabilities of transition from the chords Y to the chords X.

By carrying out steps S11 through S13 constituting the featuring quantity extracting process discussed above, the featuring quantity extraction unit 41 extracts by the featuring quantity extracting process illustratively three kinds of featuring quantities (i.e., simultaneous chord appearance probability, chord transition destination probability, and chord transition origin probability) for each of the 24 chords made up of the major chords C, C♯, D, D♯, E, F, F♯, G, G♯, A, B♭, and B; and of the minor chords Cm, C♯m, Dm, D♯m, Em, Fm, F♯m, Gm, G♯m, Am, B♭m, and Bm.

As a result, in each musical composition (i.e., the musical compositions 1 through N), each of the chords (C, C♯, D, D♯, E, F, F♯, G, G♯, A, B♭, B, Cm, C♯m, Dm, D♯m, Em, Fm, F♯m, Gm, G♯m, Am, B♭m, and Bm) is given a total of 72 featuring quantities (=3×24).

Illustratively, the featuring quantity extraction unit 41 causes the recording unit 18 (or RAM 13 or the like) to record the featuring quantities extracted from the musical compositions 1 through N and shown in the example in FIG. 11. That is, the featuring quantity extraction unit 41 first extracts the featuring quantities from the musical compositions 1 through N that are stored on the recording unit 18, and then makes the extracted featuring quantities shown in FIG. 11 recorded to the recording unit 18. In other words, the featuring quantities of chords are extracted beforehand from a large number of musical compositions.

Because the featuring quantities indicated in the example of FIG. 11 are retained on the recording unit 18 at this point, the chord similarity calculation unit 42 may retrieve and utilize some of the recorded featuring quantities as needed. As will be discussed later in more detail, when calculating the similarities between chord progressions, the chord similarity calculation unit 42 may utilize the correlation between the featuring quantity vectors (vector correlation) derived from the chord progressions of interest and calculate the similarity.

Illustratively, as shown in the table FIG. 11, the featuring quantity (vector) of the item denoting the chord C in the leftmost column, indicated as V(C), is associated with a total of 72 featuring quantities (i.e., 3 quantities multiplied by 24 major and minor chords). Each chord with its featuring quantities (vector elements) may be indicated hereunder by the character V followed by the chord name in parentheses. The chord V(C♯) is thus associated likewise with 72 featuring quantities, and so is each of the other chords V(D) through V(Bm).

That is, the chords V(C) through V(Bm) have a total of 72 featuring quantities each.

In step S3 back in the flowchart of FIG. 5, the chord progression analyzing unit 31 checks to determine whether the user has input any chord progression with a view to retrieving desired musical compositions, on the basis of operation signals supplied from the input unit 16.

If in step S3 the user is not found to have input any chord progression, then the above-described check of step S3 is repeated. In other words, the personal computer 1 waits for the user to input a chord progression.

If in step S3 the user is found to have input a chord progression, then step S4 is reached. In step S4, the chord similarity calculation unit 42 carries out the predetermined process to calculate the similarities between chord progressions (and their chords) based on the featuring quantities extracted from the waveforms of the musical compositions. Illustratively, the chord similarity calculation unit 42 in step S4 carries out the predetermined process for calculating the similarities between the chord progressions (chords) on the basis of the featuring quantities which are recorded on the recording unit 18 and which were extracted from the musical compositions of interest (musical compositions 1 through N) as shown in FIG. 11.

Figure 12:
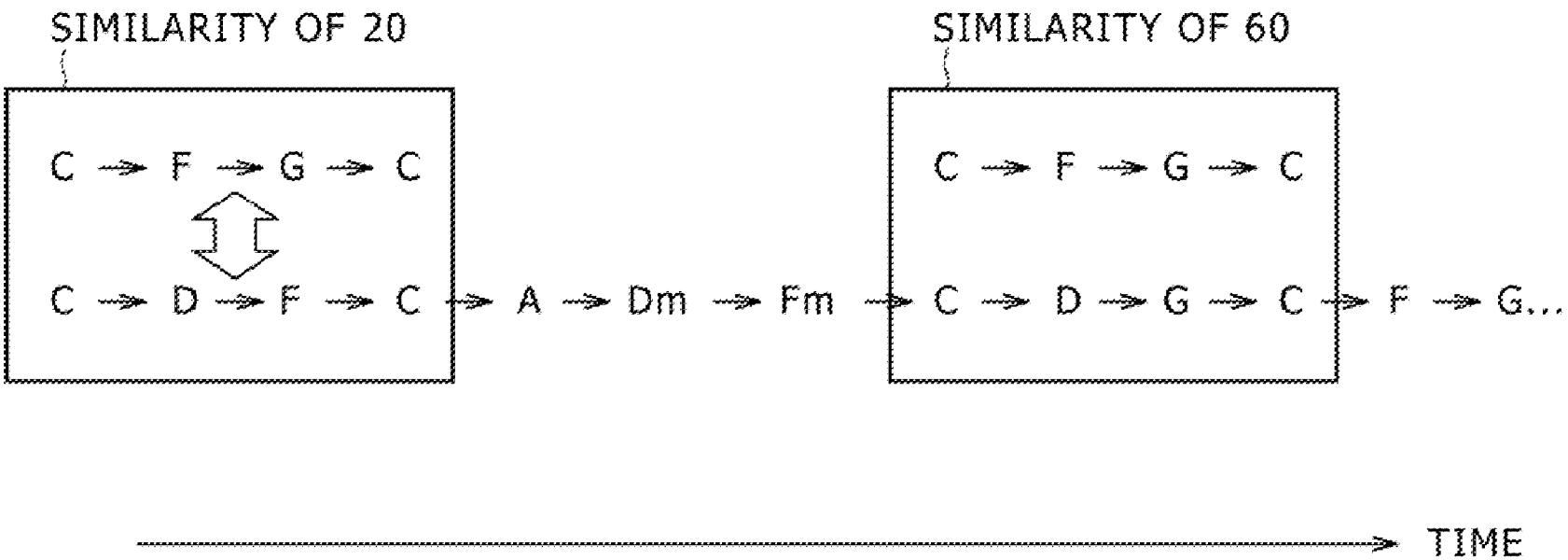
FIG. 12 is a schematic view detailing how similarities are calculated between chord progressions.
Figures 13, 14:
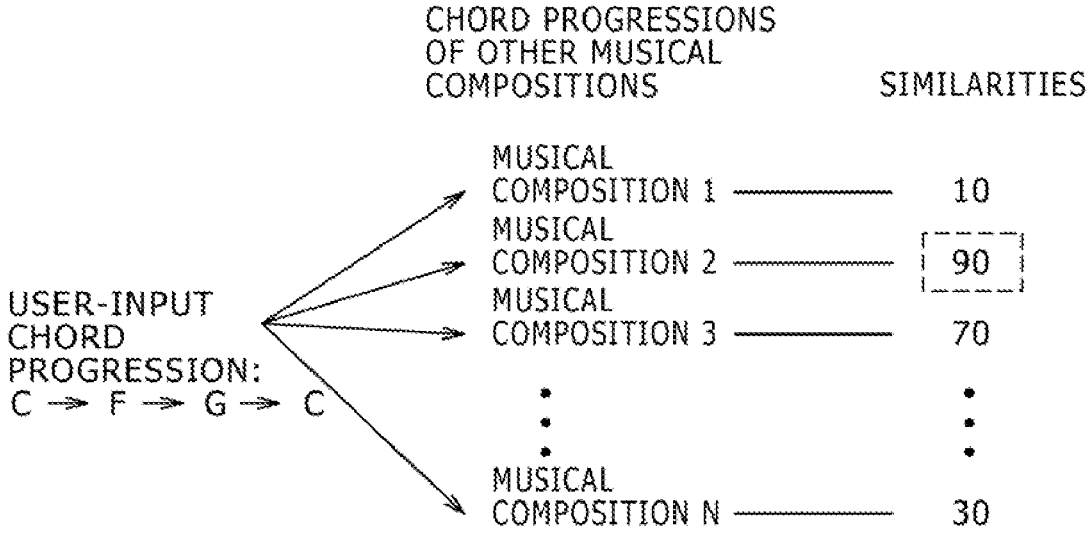
FIG. 13 is another schematic view detailing how similarities are calculated between chord progressions.
FIG. 14 is another schematic view detailing how similarities are calculated between chord progressions.

What follows is a detailed description, in reference to FIGS. 12 through 14, of how the chord similarity calculation unit 42 calculates the similarities between chord progressions.

As shown in an example in FIG. 12, the user-input chord progression indicated in the upper part of the schematic view is shifted little by little in comparison with the chord progression of the target musical composition presented in the lower part of the figure. The similarities between the two chord progressions (i.e., between their chords) being compared are then calculated.

More specifically, suppose that the chord progression input by the user in the process of step S3 is C-->F-->G-->C (this notation signifies that the chord progression changes from C to F to G to C; the same notation may be used hereunder) and that the musical composition 2 as a comparison target is made up of the chords C, D, F, C, A, Dm, Fm, C, D, G, C, F, G, progressing in that order. In such a case, the user-input chord progression C-->F-->G-->C is first compared with a chord progression of C-->D-->F-->C in the target musical composition 2 for the calculation of similarities therebetween.

The similarities between the chord progressions of interest may be calculated illustratively using the correlation between the vectors (vector correlation) of the featuring quantities derived from these chord progressions.

More specifically, the featuring quantities of the chord progression C-->F-->G-->C may be expressed in terms of the featuring quantities of the chords C, F, G and C, the quantities being recorded illustratively on the recording unit 18. The featuring quantities of the chord progression C-->D-->F-->C from the musical composition 2 may be represented in terms of the featuring quantities of the chords C, D, F and C, the quantities being retained on the recording unit 18.

As shown in an example in FIG. 13, the four chords V(C-->F-->G-->C) constituting the user-input chord are each associated with 72 featuring quantities, the featuring quantities being recorded on the recording unit 18. This amounts to a total of 288 featuring quantities. Likewise, the four chords V(C-->D-->F-->C) constituting part of the target musical composition 2 are each associated with 72 featuring quantities of each of the chord progressions, the featuring quantities also being stored on the recording unit 18. This also amounts to a total of 288 featuring quantities.

Based on these featuring quantities recorded on the recording unit 18, the chord similarity calculation unit 42 calculates the similarities between chords using vector correlation. Illustratively, the chord similarity calculation unit 42 calculates the similarities between the chord progressions using the vector correlation between V(C-->F-->G-->C) (i.e., V(C), V(F), V(G), V(C)) and V(C-->D-->F-->C) (i.e., V(C), V(D), V(F), V(C)).

The similarity based on vector correlation (correlation coefficient r) may be calculated illustratively using the following expression (1):

$$r = \frac{\frac{1}{n-1}\sum_{i=1}^{n}(X_i - \overline{X})(Y_i - \overline{Y})}{\sqrt{\frac{1}{n-1}\sum_{i=1}^{n}(X_i - \overline{X})^2}\sqrt{\frac{1}{n-1}\sum_{i=1}^{n}(Y_i - \overline{Y})^2}} \quad (1)$$

where, the correlation coefficient r denotes the degree of correlation between the vector X and the vector Y; $\overline{X}$ represents the mean value of the vector X; $\overline{Y}$ stands for the mean value of the vector Y; and n indicates the number of samples (e.g., number of combinations of the vector X with the vector Y).

It follows that upon comparison of "C-->F-->G-->C" with "C-->D-->F-->C," the number of vector elements (i.e., featuring quantities) amounts to 288 (=72×4), the chord count being multiplied by the number of featuring quantities per chord as described above.

By use of the expression (1) above, it is thus possible to calculate the correlation coefficient r (similarity) between V(C-->F-->G-->C) and V(C-->D-->F-->C), each chord progression having a total of 288 featuring quantities.

Returning to FIG. 12 for example, the chord similarity calculation unit 42 calculates the degree of similarity between the chord progressions which is calculated at 20 based on the vector correlation between the user-input V(C-->F-->G-->C) and the chord progression V(C-->D-->F-->C) in the target musical composition 2 (the similarity 20). The user-input C-->F-->G-->C is then shifted little by little for effecting the calculation of similarities between the chord progressions.

For example, as shown in FIG. 12, by shifting little by little the user-input C-->F-->G-->C, the chord similarity calculation unit 42 calculates similarity between the chord progressions which is calculated at 60 based on the vector correlation between V(C-->F-->G-->C) and a chord progression of V(C-->D-->G-->C) in the target musical composition 2 (the similarity 60). Thereafter, similarities are calculated between the user-input chord progression and each of the chord progressions in the musical composition 2, until the end of the musical composition 2. As a result, chord similarity calculation unit 42 obtains a plurality of similarities for chord progressions found in the musical composition 2.

From the plurality of similarities thus calculated, the chord similarity calculation unit 42 selects the highest similarity as the similarity the target musical composition with regard to the user-input chord progression. For example, if the similarities obtained from the musical composition 2 are 0, 10, 20, . . . 60, . . . 90, then the chord similarity calculation unit 42 determines the similarity between the chord progressions of 90 (similarity 90) as the similarity representing the musical composition 2.

Likewise, the chord similarity calculation unit 42 calculates the similarities between the user-input chord progression C-->F-->G-->C and each of the chord progressions of musical compositions 1 and 3 through N.

Illustratively, as shown in an example in FIG. 14, the chord similarity calculation unit 42 calculates the similarities between the user-input chord progression on the one hand and the chord progression in each of the musical compositions 1 through N on the other hand. The chord similarity calculation unit 42 thus acquires a similarity of 10 for the musical composition 1, a similarity of 90 for the musical composition 2, a similarity of 70 for the musical composition 3, similarities for the musical compositions 4 through N−1, and a similarity of 30 for the musical composition N. This means that the musical composition 2 with its highest similarity has the chord progression that is most similar to the user-input chord progression.

In the preceding example, the user-input chord progression was compared with the chord progression of the target musical composition in increments of four chords. However, this is not limitative of the present invention. Alternatively, the chord progressions may be compared in increments of one or a plurality of chords (1, 2, 3, 5, 10, . . . ).

In step S5 back in the flowchart of FIG. 5, the musical composition retrieving unit 43 retrieves musical compositions based on the result of the chord progression similarities calculated. Illustratively, the musical composition retrieving unit 43 in step S5 searches the musical compositions (i.e., their data) stored in the recording unit 18 by sorting them in descending order of the similarities based on the calculating result of the similarities between the user-input C-->F-->G-->C on the one hand and each of the chord progressions in the musical compositions 1 through N on the other hand. The retrieved results are the musical compositions 2, 3, . . . N, . . . 1, . . . , in that order.

In step S6, the chord progression analyzing unit 31 causes the output unit 17 to display on its screen such as LCD the retrieved results of the musical compositions. This terminates the musical composition retrieving process.

FIG. 15 is a schematic view showing a typical screen of the output unit 17 displaying retrieved results of musical compositions.

The screen of the output unit 17 displays the musical compositions 2, 3, . . . N, 1, . . . , in descending order of their similarities, as the musical composition similar to the user-input C-->F-->G-->C on the basis of the results of searching the musical compositions by the musical composition retrieving unit 43. This enables the user to know that the musical composition 2 has the chord progression with the highest similarity to the chord progression transits in order of C, F, G, C.

Because the embodiment of the invention allows the user to retrieve musical compositions with their chord progressions similar to the user-input chord progression, if a major chord progression is input, then musical compositions of cheerful tunes may be retrieved; if a minor chord progression is input, then musical compositions of somber tunes may be retrieved.

Thanks to the ability to retrieve musical compositions having chord progressions similar to the user-input chord progression, the user can check to determine whether a chord progression of his or her own musical composition has a chord progression similar to that of any other musical composition composed by someone else.

In the manner described above, the personal computer 1 performs the musical composition retrieving process using the chords constituting the analyzed chord progressions as featuring quantities. Even if the chord progressions analyzed by the chord progression analyzing unit 31 in step S1 from the waveforms of a plurality of musical compositions turned out to be erroneous, the personal computer 1 can still determine similar chord progressions. This makes it possible for the personal computer 1 to discern correctly similar chord progressions.

The featuring quantities of chord progressions are not limited to those related to the chords making up the analyzed chord progressions as discussed above. Alternatively, it is possible to adopt featuring quantities that may be, for example, related to the chord progressions. The featuring quantities may be related to either chords or their chord progressions.

Described below in reference to FIGS. 16 through 23 are processes in which the featuring quantity extraction unit 41 extracts the featuring quantities of chord progressions as part of the analyzed chord progressions.

Figure 16:
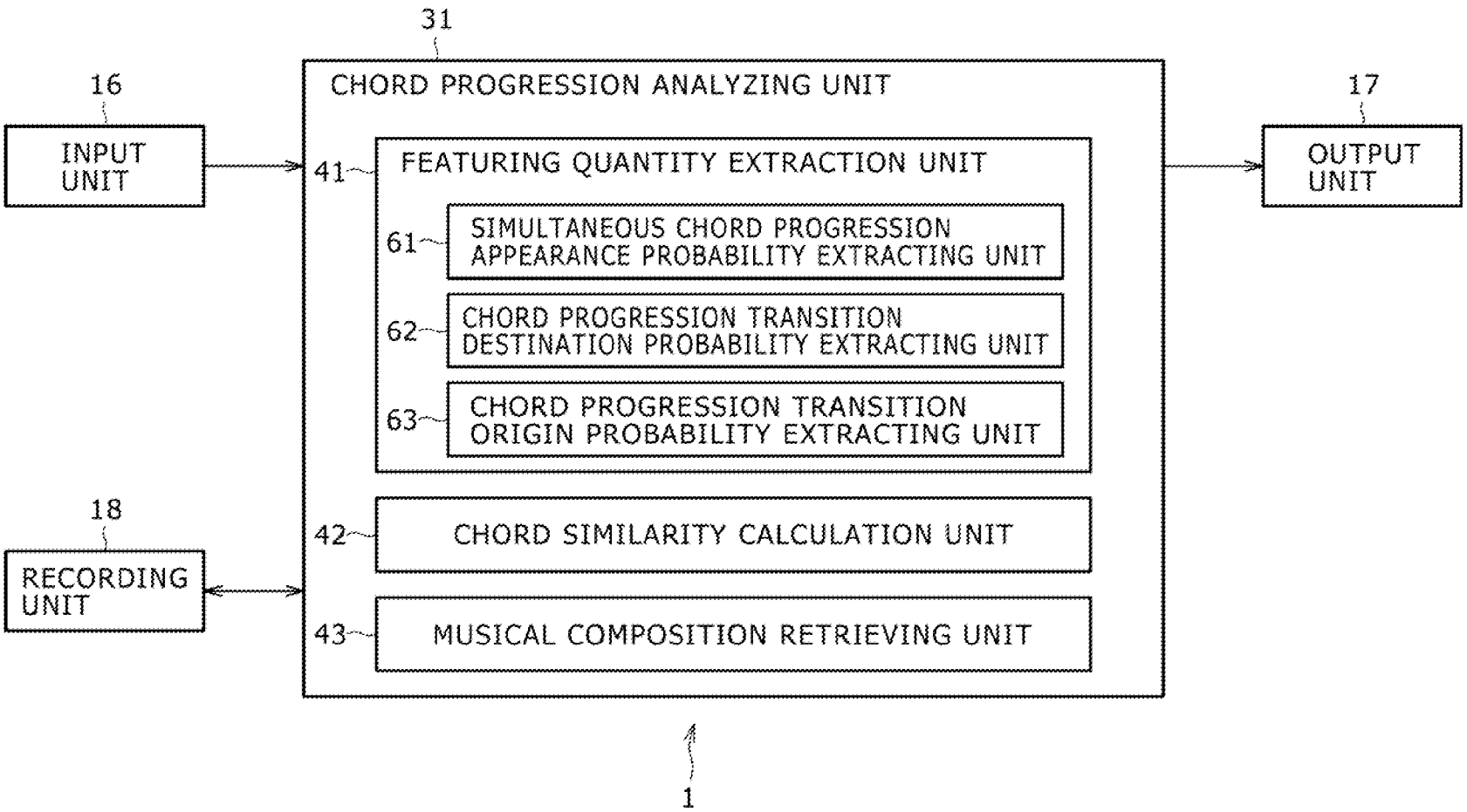
FIG. 16 is a block diagram showing another typical functional structure of a personal computer.

FIG. 16 is a block diagram showing another typical functional structure of the personal computer 1.

Of the reference numerals in FIG. 16, those already used in FIG. 4 designate like or corresponding parts, and their descriptions will be omitted hereunder where redundant. In FIG. 16, the featuring quantity extraction unit 41 is structured to include a simultaneous chord progression appearance probability extracting unit 61, a chord progression transition destination probability extracting unit 62, and a chord progression transition origin probability extracting unit 63 replacing respectively the simultaneous chord appearance probability extracting unit 51, chord transition destination probability extracting unit 52, and chord transition origin probability extracting unit 53 constituting the featuring quantity extraction unit 41 in FIG. 4.

With this embodiment, the personal computer 1 has the same hardware structure as that shown in FIG. 3. The chord progression analyzing unit 31 is thus implemented illustratively in the form of software (program) for execution by the CPU 11 in FIG. 3. Alternatively, the hardware structure of the personal computer 1 may be rendered different from that in FIG. 3, with the chord progression analyzing unit 31 constituted either as a hardware unit or as a combination of software and hardware elements.

From the chord progressions analyzed from the waveforms of musical compositions, the simultaneous chord progression appearance probability extracting unit 61 extracts (i.e., calculates) the probability of a given chord progression appearing simultaneously with another chord progression (the simultaneous chord progression appearance probability).

If a given chord progression appears from the chord progressions analyzed from the waveforms of musical compositions, the chord progression transition destination probability extracting unit 62 extracts (calculates) the probability of a given chord progression making transition to each of chord (the chord progression transition destination probability).

If a given chord appears from the chord progressions analyzed from the waveforms of musical compositions, the chord progression transition origin probability extracting unit 63 extracts (calculates) the probability of a given chord originating from each of the other chord progressions (the chord progression transition origin probability).

Figure 17:
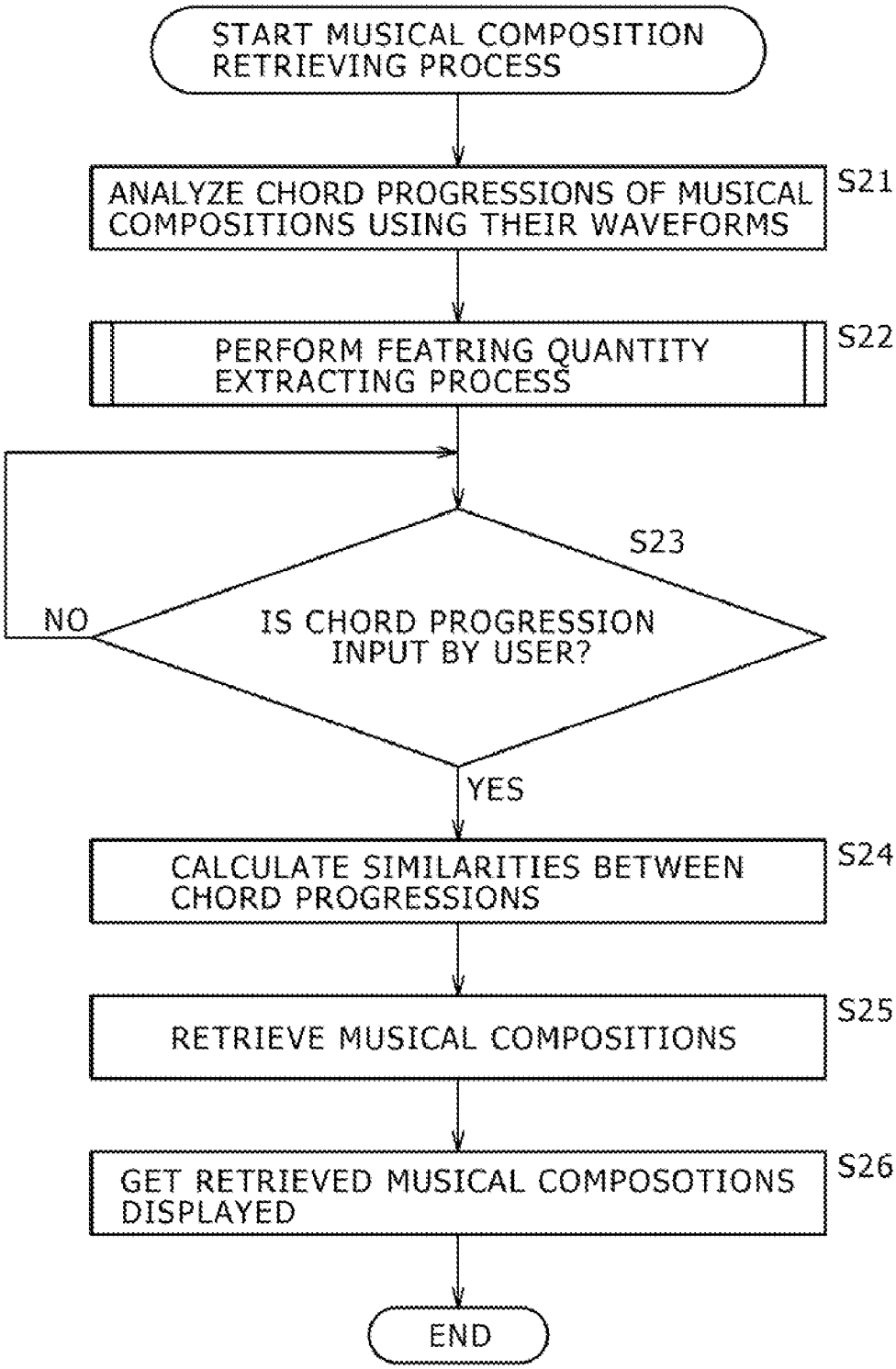
FIG. 17 is a flowchart of steps constituting another musical composition retrieving process performed by the personal computer.

Described below in reference to the flowchart of FIG. 17 is a musical composition retrieving process performed by the personal computer 1 when featuring quantities are extracted not from the chords but from the chord progressions making up the analyzed chord progressions.

What takes place in step S21 is the same as in step S1 of FIG. 5 and thus will not be discussed further.

In step S22, the featuring quantity extraction unit performs a featuring quantity extracting process on the chord progressions analyzed from the waveforms of a plurality of musical compositions and extracts the featuring quantities. Illustratively, the featuring quantity extraction unit 41 in step S22 analyzes the relations between chord progressions appearing simultaneously or the transition relations between chord progressions, the chord progressions having been analyzed from the waveforms of the musical compositions and extracts the featuring quantities. The featuring quantities extracted from the analysis are recorded illustratively to the recording unit 18 (or to the RAM 13 or the like). The relations between chord progressions appearing simultaneously or the transition relations between chord progressions will be discussed later in detail.

The featuring quantity extracting process of step S22, performed by the featuring quantity extraction unit 41, will now be described below in detail with reference to the flowchart of FIG. 18.

In step S31, the simultaneous chord progression appearance probability extracting unit 61 extracts the probabilities of chord progressions appearing simultaneously from the chord progressions of the analyzed musical compositions. Illustratively, the simultaneous chord progression appearance probability extracting unit 61 in step S31 extracts the probability of a given chord progression appearing simultaneously with each of the other chord progressions in the musical compositions 1 through N (the probability of given chord progressions appearing simultaneously).

FIG. 19 is a schematic view showing typical simultaneous chord progression appearance probabilities extracted (i.e., calculated) by the simultaneous chord progression appearance probability extracting unit 61.

In the table shown in the upper half of FIG. 19, the leftmost column and the topmost row have items denoting chord names. Although not all chords are shown here for purpose of simplification and illustration, the second item from top in the leftmost column denotes the chord progression C-->C (the notation signifies the transition from the chord C to the chord C; the same notation may be used hereunder), the third item from top indicates the chord progression C-->C♯, and the fourth item from top shows the chord progression C-->D. From the fifth item down in the leftmost column, further chords (chord progressions) originating from the chord C are assumed to appear, with the destination chords ranging from major to minor chords including D♯, E, F, F♯, G, G♯, A, B♭, B, Cm, C♯m, Dm, D♯m, Em, Fm, F♯m, Gm, G♯m, Am, B♭m, and Bm. The chords (chord progressions) originating from each of the chords are also assumed to appear, with the destination chords ranging from major to minor chords including C, C♯, D, D♯, E, F, F♯, G, G♯, A, B♭, B, Cm, C♯m, Dm, D♯m, Em, Fm, F♯m, Gm, G♯m, Am, B♭m, and Bm.

Likewise, the second item from left in the topmost row denotes the chord progression C-->C, the third item from left indicates the chord progression C-->C♯, and the fourth item from left shows the chord progression C-->D. From the fifth item on in the topmost row, further chords (chord progressions) originating from the chord C are assumed to appear, with the destination chords ranging from major to minor chords including D♯, E, F, F♯, G, G♯, A, B♭, B, Cm, C♯m, Dm, D♯m, Em, Fm, F♯m, Gm, G♯m, Am, B♭m, and Bm. The chords (chord progressions) originating from each of the chords other than the chord C are also assumed to appear, with the destination chords ranging from major to minor chords including C, C♯, D, D♯, E, F, F♯, G, G♯, A, B♭, B, Cm, C♯m, Dm, D♯m, Em, Fm, F♯m, Gm, G♯m, Am, B♭m, and Bm.

In other words, the table shown in an example in FIG. 19 constitutes a matrix of cells representing the chord progressions C-->C, C-->C♯, C-->D, . . . , Am-->Bm, B♭m-->Bm, Bm-->Bm in the leftmost column (for 24×24=576 rows), and the chord progressions C-->C, C-->C♯, C-->D, . . . , Am-->Bm, B♭m-->Bm, Bm-->Bm in the topmost row (for 24×24=576 columns).

The chord progressions shown in the lower half of FIG. 19 are those of the musical compositions 1 through N mentioned above. The simultaneous chord progression appearance probability is extracted illustratively for a given chord progression (e.g., C-->F) appearing simultaneously with another chord progression (e.g., D-->G), in the musical compositions 1 through N as indicated by broken lines in FIG. 19.

The table shown in the example in FIG. 19 shows illustratively the simultaneous chord progression appearance probabilities regarding the chord progressions in the musical compositions 1 through N.

More specifically, in the musical compositions 1 through N, the probability of each of the chord progressions C-->C through C-->E appearing simultaneously with another chord progression is extracted. The probability of the chord progression C-->F appearing simultaneously with the chord progression D-->G is extracted at 13%, with the chord progression D-->G♯ at 1%, . . . , and with the chord progression Bm-->Bm at 0%. Likewise, in the musical compositions 1 through N, the probability of the chord progression C-->F♯ appearing simultaneously with the chord D-->G is extracted at 1%, with the chord progression D-->G♯ at 0%, . . . , and with the chord progression Bm-->Bm at 0%.

Similarly, in the musical compositions 1 through N, the probability of each of the chord progressions C-->G through B♭m-->Bm appearing simultaneously with another chord progression is extracted. In particular, the probability of the chord progression Bm-->Bm appearing simultaneously with the chord progression D-->G is extracted at 0%, with the chord progression D-->G♯ at 0%, . . . , and with the same chord progression Bm-->Bm at 0%.

As described, from the musical compositions 1 through N, a total of 576 (=24×24) simultaneous chord progression appearance probabilities are acquired for each of the chord progressions (C-->C through Bm-->Bm).

In other words, through the process of step S31, the simultaneous chord progression appearance probability extracting unit 61 may be said to extract the relations between chord progressions appearing simultaneously, by calculating the simultaneous appearance probabilities for each of the chord progressions in the musical compositions (i.e., musical compositions 1 through N).

Figure 18:
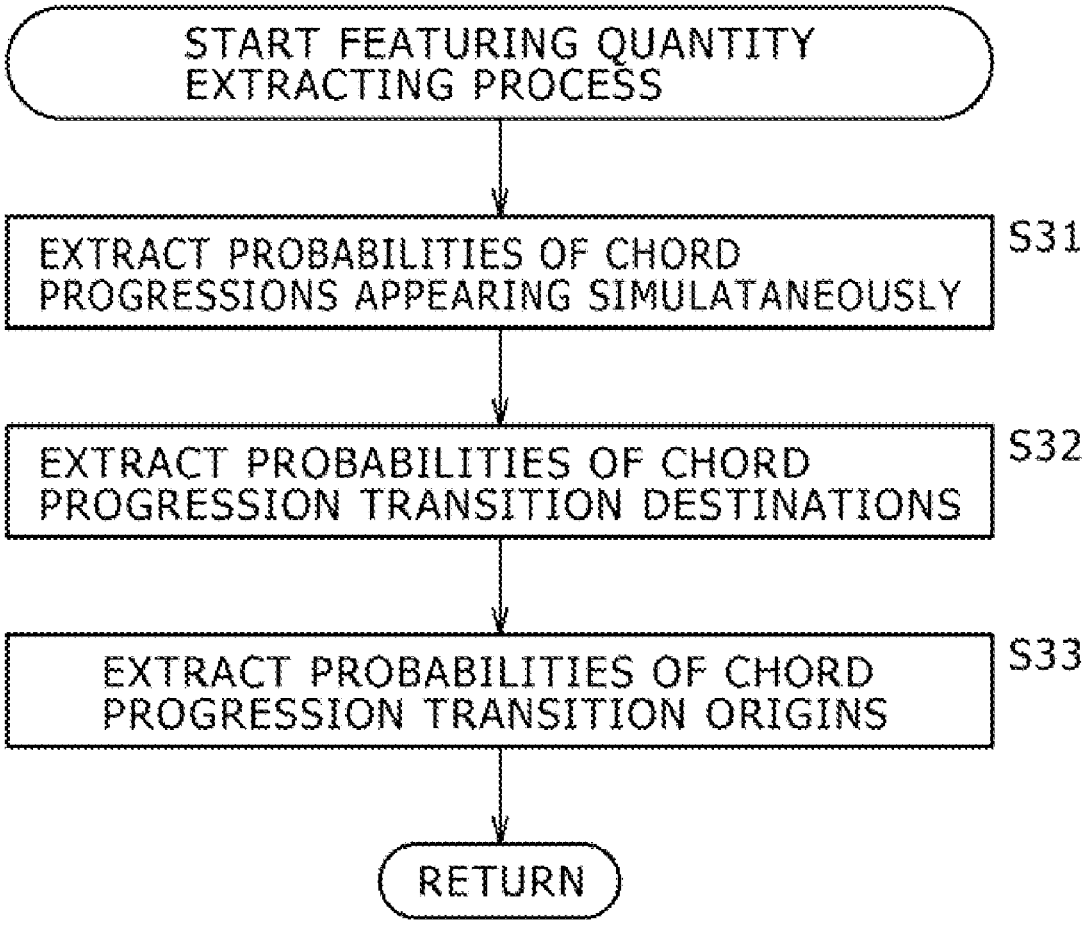
FIG. 18 is a flowchart of detailed steps constituting another featuring quantity extracting process performed by a featuring quantity extraction unit.

In step S32 back in the flowchart of FIG. 18, the chord progression transition destination probability extracting unit 62 extracts the probabilities of chord of chord progression transition destinations based on the chord progressions of the analyzed musical compositions. For example, the chord progression transition destination probability extracting unit 62 in step S32 extracts if a given chord progression appears the probability of transition of a given chord progression to another chord from the chord transitions in the musical compositions 1 through N (the chord progression transition destination probability).

FIG. 20 is a schematic view showing typical chord progression transition destination probabilities extracted (i.e., calculated) by the chord progression transition destination probability extracting unit 62.

In the table shown in the upper half of FIG. 20, the leftmost column has the items representing the same chord names as those in the example of the table of FIG. 19, and their descriptions are omitted hereunder. Although not all chords are shown in the topmost row for purpose of simplification and illustration, the second item from left in this row denotes the chord C, the third item from left indicates the chord C♯, and the fourth item from left shows the chord D. From the fifth item on in the topmost row, further chords are assumed to appear, ranging from major to minor chords including D♯, E, F, F♯, G, G♯, A, B♭, B, Cm, C♯m, Dm, D♯m, Em, Fm, F♯m, Gm, G♯m, Am, B♭m, and Bm.

In other words, the table shown in an example in FIG. 20 constitutes a matrix of cells representing the chord progressions C-->C, C-->C♯, C-->D, . . . , Am-->Bm, B♭m-->Bm, Bm-->Bm in the leftmost column (for 24×24=576 rows), and the chords C, C♯, D, . . . , Am, B♭m, Bm in the topmost row (for 24 columns).

The example in FIG. 20 shows illustratively the chord progression transition destination probabilities regarding the chord progressions in the musical compositions 1 through N.

More specifically, in the musical compositions 1 through N, the probability of, say, the chord progression C-->C making transition to another chord such as the chord G is extracted at 0%, to the chord G♯ at 0%, to the chord A at 0%, . . . , and to the chord Bm at 0%. Likewise, in the musical compositions 1 through N, the probability of one of the chord progressions C-->C♯ through E-->Bm such as the chord progression F-->C making transition to another chord such as the chord G is extracted at 6%, to the chord G♯ at 0%, to the chord A at 1%, . . . , and to the chord Bm at 0%. Similarly, in the musical compositions 1 through N, the probability of one of the chord progressions F-->C♯ through Bm-->B♭m such as the chord progression Bm-->Bm making transition to another chord such as the chord G is extracted at 0%, to the chord G♯ at 0%, to the chord A at 0%, . . . , and to the chord Bm at 0%.

In the manner described above, from the chord progression of the musical compositions 1 through N, a total of 24 chord progression transition destination probabilities are acquired for each of the chord progressions (C-->C through Bm-->Bm).

In other words, through the process of step S32, the chord progression transition destination probability extracting unit 62 may be said to extract the transition relations between chord progressions, by calculating the chord progression transition destination probabilities for each of the chord progressions in the musical compositions (i.e., musical compositions 1 through N).

In step S33 back in the flowchart of FIG. 18, the chord progression transition origin probability extracting unit 63 extracts the probabilities of chord of chord progression transition origins based on the chord progressions of the analyzed musical compositions. This step terminates the featuring quantity extracting process. Illustratively, the chord progression transition origin probability extracting unit 63 in step S33 calculates if a given chord progression appears the probability of a given chord progression originating from the same or each of the other chords in the chord progressions of the musical compositions 1 through N (the chord progression transition origin probability).

FIG. 21 is a schematic view showing typical chord progression transition origin probabilities extracted (i.e., calculated) by the chord progression transition origin probability extracting unit 63.

In the table shown in FIG. 21, the leftmost column and the topmost row contain the items representing the same chord progressions and chord names as those in the example of the table of FIG. 20, and their descriptions are omitted hereunder.

An example in FIG. 21 shows illustratively the chord progression transition origin probabilities regarding the musical compositions 1 through N.

More specifically, for example, in the musical compositions 1 through N, the probability of the chord progression C-->C originating from a given chord such as the chord G♯m is extracted at 0%, . . . from the chord Am at 0%, . . . and from the chord Bm at 0%. Similarly, in the musical compositions 1 through N, the probability of one of the chord progressions C-->C♯ through C-->F♯ such as the chord progression C-->G originating from a given chord such as the chord G♯m is extracted at 0%, from the chord Am at 6%, . . . and from the chord Bm at 0%.

Likewise, in the musical compositions 1 through N, the probability of one of the chord progressions C-->G♯ through B♭m-->Bm such as the chord progression Bm-->Bm originating from a given chord such as the chord G♯m is extracted at 0%, from the chord Am at 0%, . . . and from the chord Bm at 0%.

As described above, from the musical compositions 1 through N, a total of 24 chord progression transition origin probabilities are acquired for each of the chord progressions (C-->C through Bm-->Bm).

In other words, through the process of step S33, the chord progression transition origin probability extracting unit 63 may be said to extract the transition relations between chord progressions by calculating the probabilities of one chord progression originating from another chord progression in the musical compositions (i.e., musical compositions 1 through N).

Figure 22:
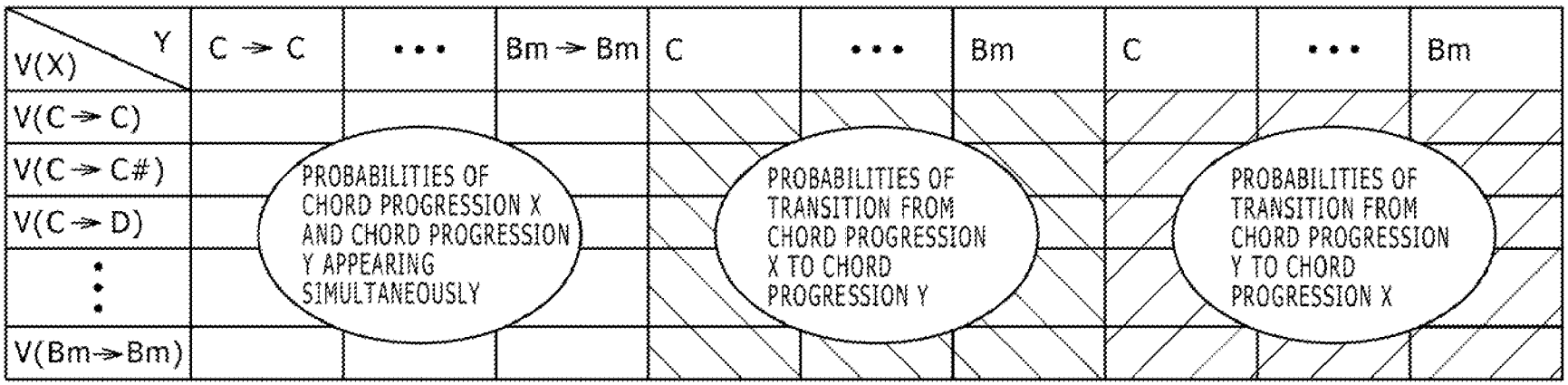
FIG. 22 is a schematic view explanatory of featuring quantities extracted by the featuring quantity extraction unit.

FIG. 22 is a schematic view explanatory of featuring quantities extracted by the featuring quantity extraction unit 41.

An example shown in the table in FIG. 22 integrates three tables as one crosswise: table of simultaneous chord progression appearance probabilities (FIG. 19), table of chord progression transition destination probabilities (FIG. 20), and table of chord progression transition origin probabilities (FIG. 21). In the table of FIG. 22, the items in the leftmost column stand for chord progressions X (indicated as V(X) in the figure; the reason for this will be discussed later), and the items in the topmost row denote chord progressions Y. The items in the leftmost column and the second through the 577th items from left in the topmost row constitute cells (shown blank in the table in FIG. 22) representing the simultaneous transition appearance probabilities of each of the chord progressions X in combination with each of the chord progressions Y. The items in the leftmost column and the 578th through the 601st items from left in the topmost row make up cells (shown shaded with falling diagonals in the table in FIG. 22) indicating the probabilities of transition from each of the chord progressions X to each of the chord progressions Y. The items in the leftmost column and the 602nd through the 625th items from left in the topmost row form cells (shown shaded with rising diagonals in the table in FIG. 22) denoting the probabilities of transition from each of the chord progressions Y to each of the chord progressions X.

By carrying out steps S31 through S33 discussed above, constituting the featuring quantity extracting process, the featuring quantity extraction unit 41 extracts illustratively three kinds of featuring quantities (i.e., simultaneous chord progression appearance probability, chord progression transition destination probability, and chord progression transition origin probability) for each of 576 chord progressions ranging from C-->C to Bm-->Bm, for example.

As a result, in each musical composition (i.e., each of the musical compositions 1 through N), each of the chord progressions (C-->C through Bm-->Bm) is given a total of 624 featuring quantities (=24×24+24+24).

Illustratively, the featuring quantity extraction unit 41 causes the recording unit 18 (or RAM 13) to record the featuring quantities extracted from the musical compositions 1 through N and shown in FIG. 22. That is, the featuring quantity extraction unit 41 first extracts the featuring quantities from the musical compositions 1 through N that are stored on the recording unit 18, and then gets the extracted featuring quantities (shown in FIG. 22) recorded to the recording unit 18. In other words, the featuring quantities of chord progressions are extracted beforehand from a large number of musical compositions for later use.

Because the featuring quantities indicated in the example of FIG. 22 are retained on the recording unit 18 at this point, the chord similarity calculation unit 42 may retrieve and utilize some of the recorded featuring quantities as needed. As discussed above, when calculating the similarities between chord progressions, the chord similarity calculation unit 42 may utilize the vector correlation between the featuring quantities derived from the chord progressions in question.

Illustratively, as shown in the table in FIG. 22, the item denoting the chord progression V(C-->C) in the leftmost column in the table in FIG. 11 is associated with a total of 624 featuring quantities (=24×24+24+24). Likewise, the chord progression V(C-->C♯) is associated with 624 featuring quantities, the chord progression V(C-->D) with 624 featuring quantities, . . . , and the chord progression V(Bm-->Bm) with 624 feature quantities.

That is, the chord progressions V(C-->C) through V (Bm-->Bm) have a total of 624 featuring quantities each.

Returning to the flowchart of FIG. 17, what takes place in step S23 is the same as in step S3 of FIG. 5 and thus will not be discussed further.

In step S24, the chord similarity calculation unit calculates the similarities between chord progressions (and their chords) based on the featuring quantities constituted by the simultaneous chord progression appearance probabilities, chord progression transition destination probabilities, and chord progression transition origin probabilities acquired, for example. Illustratively, the chord similarity calculation unit 42 in step S24 carries out the predetermined process for calculating the similarities between the chord progressions (chords) on the basis of the featuring quantities which are recorded on the recording unit 18 and which were extracted from the musical compositions of interest (1 through N) as shown in FIG. 22.

More specifically, as discussed above, it is assumed that the chord progression input by the user is C-->F-->G-->C and that the musical composition 2 as a comparison target is made up of the chords C, D, F, C, A, Dm, Fm, C, D, G, C, F, G, . . . , progressing in that order. In such a case, the user-input chord progression C-->F-->G-->C is first compared with a chord progression of C-->D-->F-->C in the target musical composition 2 for the calculation of similarities therebetween by use of the vector correlation for example, between the featuring quantities of the chord progressions.

In particular, the featuring quantities of the chord progression C-->F-->G-->C may be expressed in terms of the featuring quantities of the chord progressions C-->F, F-->G, and G-->C, the quantities being recorded illustratively on the recording unit 18. The featuring quantities of the chord progression C-->D-->F-->C from the musical composition 2 may be represented in terms of the featuring quantities of the chord progressions C-->D, D-->F, and F-->C, the quantities being also retained on the recording unit 18, for example.

As shown in an example in FIG. 23, the chord progressions V(C-->F), V(F-->G), and V(G-->C) constituting the user-input chord V(C-->F-->G-->C) are each associated with 624 featuring quantities of each of the chord progressions, the featuring quantities being recorded on the recording unit 18. This amounts to a total of 1,872 featuring quantities. Likewise, the chord progressions V(C-->D) V(D-->F), and V (F-->C) constituting the chord progression V(C-->D--> F-->C) of the target musical composition 2 are each associated with 624 featuring quantities of each of the chord progressions, the featuring quantities also being stored on the recording unit 18. This also amounts to a total of 1,872 featuring quantities.

Based on these featuring quantities recorded on the recording unit 18, the chord similarity calculation unit 42 calculates the similarities between chords using vector correlation.

Illustratively, the chord similarity calculation unit 42 calculates the similarities between the chord progressions by calculating the vector correlation between V(C-->F-->G-->C) (i.e., V(C-->F), V(F-->G), V(G-->C)) and V(C-->D-->F-->C) (i.e., V(C-->D), V(D-->F), V(F-->C)) using the expression (1).

For example, the chord similarity calculation unit 42 calculates the similarities between the chord progressions of the user-input chord progression on the one hand and the chord progressions in each of the musical compositions 1 through N on the other hand. The chord similarity calculation unit 42 thus acquires a similarity of 15 for the musical composition 1, a similarity of 85 for the musical composition 2, a similarity of 70 for the musical composition 3, similarities for the musical compositions 4 through N−1, and a similarity of 20 for the musical composition N. This means that the musical composition 2 with its highest similarity has the chord progression that is most similar to the user-input chord progression.

Returning to the flowchart of FIG. 17, what takes place in step S25 and S26 is the same as in steps S5 and S6 of FIG. 5 and thus will not be discussed further. This completes the musical composition retrieving process.

In the manner described above, the personal computer 1 performs the musical composition retrieving process using as featuring quantities the chord progressions instead of the chords making up these chord progressions. As a result, even if the chord progressions analyzed by the chord progression analyzing unit 31 in step S21 from the waveforms of a plurality of musical compositions turned out to be erroneous, the personal computer 1 can still determine similar chord progressions eventually. This makes it possible for the PC 1 to discern correctly similar chord progressions.

In the foregoing examples, the featuring quantities of chords and those of chord progressions were shown to be separately extracted. Obviously, the featuring quantities of both chords and chord progressions may be extracted and used for calculating the similarities between the chord progressions.

In that case, the featuring quantity extraction unit 41 extracts illustratively the featuring quantities of the chords shown in FIG. 11 (i.e., simultaneous chord appearance probabilities, chord transition destination probabilities, and chord transition origin probabilities) and the featuring quantities of the chord progressions indicated in FIG. 22 (simultaneous chord progression appearance probabilities, chord progression transition destination probabilities, and chord progression transition origin probabilities). The featuring quantities thus extracted are recorded to the recording unit 18 (or to the RAM 13 or the like).

The chord similarity calculation unit 42 then calculates the similarities between the chord progressions (and their chords) using as the featuring quantities the simultaneous chord appearance probabilities, chord transition destination probabilities, chord transition origin probabilities, simultaneous chord progression appearance probabilities, chord progression transition destination probabilities, and chord progression transition origin probabilities recorded illustratively on the recording unit 18.

More specifically, as discussed above, if the chord progression input by the user is C-->F-->G-->C and if the musical composition 2 as a comparison target is made up of the chords C, D, F, C, A, Dm, Fm, C, D, G, C, F, G, . . . , progressing in that order, then the user-input C-->F-->G-->C is first compared with a chord progression of C-->D-->F-->C in the target musical composition 2 for the calculation of similarities therebetween by use of the vector correlation between the featuring quantities of the chord progressions, for example.

Specifically, the featuring quantities of the chord progression C-->F-->G-->C may be expressed in terms of the featuring quantities of the chords C, F, G and C, as well as those of the chord progressions C-->F, F-->G, and G-->C, the quantities being recorded illustratively on the recording unit 18. The featuring quantities of the chord progression C-->D-->F-->C from the musical composition 2 may be represented in terms of the featuring quantities of the chords C, D, F and C, as well as those of the chord progressions C-->D, D-->F, and F-->C, the quantities being also retained on the recording unit 18.

As shown in an example in FIG. 24, the chords V(C), V(F), V(G) and V(C) constituting the user-input chord V(C-->F-->G-->C) are each associated with 72 featuring quantities of each of the chords, and the chord progressions V(C-->F), V(F-->G), and V(G-->C) making up the user-input chord progression V(C-->F-->G-->C) are each associated with 624 featuring quantities of each of the chord progressions, the featuring quantities being recorded on the recording unit 18. This amounts to a total of 2,160 featuring quantities. Likewise, the chords V(C), V(D), V(F) and V(C) constituting the chord progression V(C-->D-->F-->C) of the target musical composition 2 are each associated with 72 featuring quantities, and the chord progressions V(C-->D) V(D-->F), and V(F-->C) making up the chord progression V(C-->D-->F-->C) of the musical composition 2 are each associated with 624 featuring quantities of each of the chord progressions, the featuring quantities being recorded on the recording unit 18. This also amounts to a total of 2,160 featuring quantities.

Based on these featuring quantities recorded on the recording unit 18, the chord similarity calculation unit 42 calculates the similarities between chords using vector correlation. Illustratively, the chord similarity calculation unit 42 calculates the similarities between the chord progressions using the vector correlation between V(C-->F-->G-->C) (i.e., V(C), V(F), V(G), V(C), V(C-->F), V(F-->G), V(G-->C)) and V(C-->D-->F-->C) (i.e., V(C), V(D), V(F), V(C), V(C-->D), V(D-->F), V(F-->C)).

For example, the chord similarity calculation unit 42 calculates the similarities between the user-input chord progression on the one hand and the chord progressions in each of the musical compositions 1 through N on the other hand. The chord similarity calculation unit 42 thus acquires a similarity of 10 for the musical composition 1, a similarity of 90 for the musical composition 2, a similarity of 65 for the musical composition 3, similarities for the musical compositions 4 through N−1, and a similarity of 30 for the musical composition N. This means that the musical composition 2 with its highest similarity has the chord progression that is most similar to the user-input chord progression.

The personal computer 1 may thus retrieve musical compositions in the manner described above, using the featuring quantities of the chords making up the analyzed chord progressions as well as the featuring quantities of these chord progressions.

The featuring quantities of chord progressions are not limited to those discussed above. Alternatively, other featuring quantities regarding the chords (chord progressions) constituting the analyzed chord progressions may be used singly or in combinations. Such alternative featuring quantities may include the sporadic rate in which a given chord (or chord progression) appears in a single musical composition (e.g., if a chord appears for one minute in a five-minute musical composition, then the chord is said to have the appearance probability of 20% (=⅕)); the combined probability of chord (chord progression) X and chord (chord progression) Y appearing in combination (e.g., the appearance probability of 0.1 for chord X multiplied by the appearance probability of 0.2 for chord Y is 0.02); and the probability of a given chord progression making transition to another chord progression (e.g., the probability of transition from C-->F to G-->C).

In the foregoing examples, the chord similarity calculation unit 42 was shown to calculate the similarities between chord progressions using the correlation of the vectors of the featuring quantities therebetween (i.e., vector correlation) as a method for calculating the similarities between chord progressions. Alternatively, it is possible, according to the present invention, to perform for example the dimensional compression of acquired featuring quantities through principal component analysis or to calculate featuring quantities using distance functions such as the Euclidean distance technique.

In the foregoing examples, only the three-note major and minor chords were shown to be used for extracting featuring quantities as a featuring quantity extracting method. Alternatively, other kinds of chords including for example, four-note chords may be obviously utilized as long as they constitute a harmony each.

Figure 25:
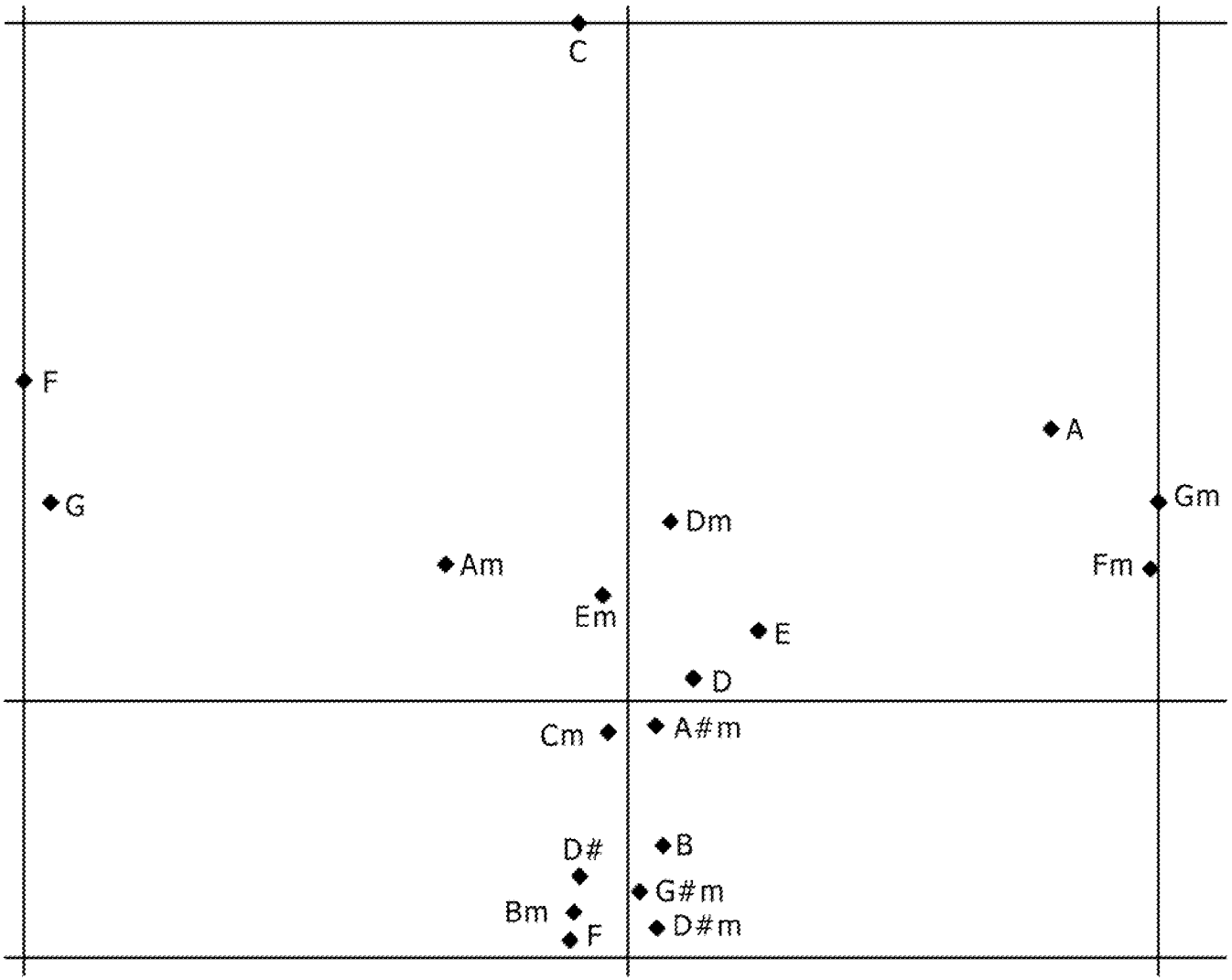
FIG. 25 is a schematic view showing an example of calculated results of principal component analysis.

FIG. 25 is a schematic view showing typical calculating results of principal component analysis performed by the chord similarity calculation unit 42.

The dots in the graphical example of FIG. 25 represent some chords of which the extracted featuring quantities were subjected to principal component analysis and which have their first and the second principal components plotted on the horizontal and vertical axes of the graph. Illustratively, the chords having the point close to each other such as D♯, Bm, F, B, G♯m and D♯m in the lower part of the graph have meanings similar to one another in musical compositions.

That is, the chord similarity calculation unit 42 calculates the similarities between chord progressions through principal component analysis so that the chords having the point close to each other shown in FIG. 25 are regarded as having meanings similar to one another in musical compositions.

It should be noted that the results of the principal component analysis vary depending on the algorithm for analyzing chord progressions as well as on the genre of the musical compositions being analyzed.

According to the present invention, as described above, it is possible to analyze chord progressions more accurately than before.

Implementing the present invention makes it possible to analyze the chord progressions of musical compositions so precisely that even if the chord progressions are initially analyzed erroneously, the chords similar to one another may eventually be grouped into similar categories. It follows that the adverse consequences resulting from the errors in the detection of chords are limited to a minimum. Illustratively, even if diverse four-note chords are detected from analyzed chord progressions, similar chord progressions can still be determined without the precision of analysis drops.

Furthermore, according to the present invention, musical compositions having chord progressions similar to the desired chord progression can be retrieved even if the progressions are not exactly the same. This allows the user to retrieve the desired musical compositions.

In the foregoing examples, the information processing device embodying the present invention was shown to be the personal computer 1. Alternatively, this invention may be embodied by a portable music player, a mobile phone, a PDA (personal digital assistant), or any other device capable of analyzing the waveforms of musical compositions. As another alternative, the invention may be implemented in the form of a dedicated server equipped with the above-described capabilities and its terminals each acting as a client of the server, the server supplying the results of its processing (e.g., retrieved musical compositions) to the terminals.

In the foregoing examples, the process for retrieving the musical compositions is explained as an example. However, this invention is not limited to those discussed above. Alternatively, of certain musical compositions recorded on the recording unit 18, a given musical composition may be compared with the other compositions by the embodiment of the invention to determine the similarities therebetween in terms of chord progressions. As another alternative, the featuring quantities extracted from the waveforms of musical compositions may be stored as metadata.

The series of the steps and processes described above may be executed either by hardware or by software. For the software-based processing to take place, the programs constituting the software may be either incorporated beforehand in dedicated hardware of a computer for program execution or installed upon use from a suitable recording medium into a general-purpose personal computer or like capable of executing diverse functions based on the installed programs.

The recording medium is offered to users not only apart from their computers and constituted by the removable media 21 (FIG. 3) such as magnetic disks (including floppy disks), optical disks (including CD-ROM (Compact Disc-Read Only Memory) and DVD (Digital Versatile Disk)), magneto-optical disks (including MD (Mini-Disc; registered trademark)), or semiconductor memory, each medium carrying the necessary programs, to be distributed to users to provide the programs; but also in the form of the ROM 12 or the recording unit 18 (FIG. 3) accommodating the programs in the state of being incorporated beforehand in the computers to be provided to the users.

The programs to carry out the series of processes described above may be installed into the computer as needed through interfaces such as routers and modems by way of wired or wireless communication media including local area networks, the Internet, or digital satellite broadcasts.

In this description, the steps describing the programs stored on the recording medium represent not only the processes that are to be carried out in the depicted sequence (i.e., on a time series basis) but also processes that may be performed parallelly or individually, even if it is not processed chronologically.

It should be understood by those skilled in the art that various modifications, combinations, sub-combinations and alterations may occur depending on design requirements and other factor in so far as they are within the scope of the appended claims or the equivalents thereof.

The invention claimed is:

1. An information processing device comprising:

chord progressions extraction means for extracting chord progressions by analyzing waveforms of musical compositions;

first featuring quantity extraction means for extracting a first probability indicating the probability of given chords appearing simultaneously in each of said chord progressions;

second featuring quantity extraction means for extracting a second probability indicating the probability of transition from a given chord to another chord in a chord progression in question; and calculation means for calculating first similarities between a chord progression and another chord progression, on the basis of the first probability and the second probability for each chord comprising the extracted chord progressions.

2. The information processing device according to claim 1, wherein said chord progressions extraction means extracts as featuring quantities either relations between said chords appearing simultaneously or transition relations between said chords.

3. The information processing device according to claim 2, further comprising:

recording means for recording said extracted featuring quantities;

wherein said calculation means calculates second similarities between the chord progression and the another chord progression, on the basis of the recorded featuring quantities.

4. The information processing device according to claim 2, wherein said calculation means calculates second similarities between chords constituting each of said chord progressions and other chords, on the basis of said extracted featuring quantities.

5. The information processing device according to claim 2, wherein said chord progressions extraction means includes:

third featuring quantity extraction means for extracting a third probability indicating the probability of transition from the another chord to the given chord in the chord progression in question;

wherein said calculation means calculates second similarities between the chord progression and the another chord progression, on the basis of said first probability, said second probability, and said third probability extracted with regard to each chord constituting said extracted chord progressions.

6. The information processing device according to claim 2, wherein said chord progressions extraction means includes:

third featuring quantity extraction means for extracting a third probability indicating the probability of given chord progressions appearing simultaneously in said chord progressions;

fourth featuring quantity extraction means for extracting a fourth probability indicating the probability of transition from a given chord progression to another chord progression in said chord progressions; and fifth featuring quantity extraction means for extracting a fifth probability indicating the probability of transition from the another chord progression to the given chord progression in said chord progressions, and wherein said calculation means calculates second similarities between the chord progression and the another chord progression, on the basis of said third probability, said fourth probability, and said fifth probability extracted with regard to each of said chord progressions.

7. The information processing device according to claim 2, wherein said calculation means calculates second similarities between any one of said chord progressions and a chord progression designated by a user, using a predetermined algorithm and on the basis of the extracted featuring quantities.

8. The information processing device according to claim 7, further comprising:

retrieval means for performing musical composition retrieval from said musical compositions on the basis of at least one of the first similarities or the second similarities.

9. The information processing device according to claim 7, wherein said algorithm involves calculating vector correlation of said featuring quantities.

10. An information processing method, implemented by at least one computer having at least one processor, the method comprising the steps of:

extracting, using chord progressions extraction means, chord progressions by analyzing waveforms of musical compositions;

extracting, using first featuring quantity extraction means, a first probability indicating the probability of given chords appearing simultaneously in each of said cord progressions;

extracting, using second featuring quantity extraction means, a second probability indicating the probability of transition from a given chord to another chord in the chord progression in question; and calculating first similarities between a chord progression and another chord progression, on the basis of the first probability and the second probability for each chord comprising the extracted chord progressions.

11. A recording medium which stores a program for causing a computer to execute a chord progression analyzing process comprising the steps of:

extracting, using chord progressions extraction means, chord progressions by analyzing waveforms of musical compositions;

extracting, using first featuring quantity extraction means, a first probability indicating the probability of given chords appearing simultaneously in each of said cord progressions;

extracting, using second featuring quantity extraction means, a second probability indicating the probability of transition from a given chord to another chord in the chord progression in question; and calculating first similarities between a chord progression and another chord progression, on the basis of the first probability and the second probability for each chord comprising the extracted chord progressions.

* * * * *